US011079119B2

(12) United States Patent
Jeon et al.

(10) Patent No.: US 11,079,119 B2
(45) Date of Patent: Aug. 3, 2021

(54) AIR CONDITIONER

(71) Applicant: Samsung Electronics Co., Ltd., Suwon-si (KR)

(72) Inventors: Hyun Joo Jeon, Hwaseong-si (KR); Woo Seog Song, Yongin-si (KR); Jong Whal Kim, Suwon-si (KR); Jin Baek Kim, Suwon-si (KR); Yeon-Seob Yun, Suwon-si (KR); Tae Woo Kim, Suwon-si (KR); Eung Ryeol Seo, Suwon-si (KR); Won-Hee Lee, Yongin-si (KR); Chang-Woo Jung, Suwon-si (KR); Jong Kweon Ha, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/936,911

(22) Filed: Mar. 27, 2018

(65) Prior Publication Data

US 2018/0209667 A1 Jul. 26, 2018

Related U.S. Application Data

(63) Continuation of application No. 15/209,098, filed on Jul. 13, 2016.

(30) Foreign Application Priority Data

Jul. 17, 2015 (KR) ..... 10-2015-0101933

(51) Int. Cl.
*F24F 1/00* (2019.01)
*F24F 1/0014* (2019.01)
(Continued)

(52) U.S. Cl.
CPC ..... *F24F 1/0014* (2013.01); *F24F 1/005* (2019.02); *F24F 1/0033* (2013.01);
(Continued)

(58) Field of Classification Search
CPC ..... F24F 1/0014; F24F 1/005; F24F 1/0033; F24F 13/068; F24F 13/10; F24F 13/12;
(Continued)

(56) References Cited

U.S. PATENT DOCUMENTS

2008/0119125 A1* 5/2008 Guerreiro ..... B60H 1/345 454/75
2012/0190293 A1 7/2012 Badenhorst
(Continued)

FOREIGN PATENT DOCUMENTS

CN 101080334 11/2007
CN 202660642 1/2013
(Continued)

OTHER PUBLICATIONS

Australian Office Action dated Aug. 14, 2018 in Australian Patent Application No. 2016297373.
(Continued)

*Primary Examiner* — Kenneth J Hansen
*Assistant Examiner* — Ryan L Faulkner
(74) *Attorney, Agent, or Firm* — Staas & Halsey LLP

(57) ABSTRACT

An air conditioner includes a housing comprising an external panel defining an external appearance and having an opening formed at the external panel; a heat exchanger configured to exchange heat with air flowing into the housing; and an air discharge unit configured to discharge air heat-exchanged by the heat exchanger out of the housing. The air discharge unit includes a first discharge unit connected to the opening and discharging air; and a second discharge unit provided at the external panel and discharging
(Continued)

air. A method of blowing heat-exchanged air may be changed in accordance with an environment of a user.

17 Claims, 28 Drawing Sheets

(51) Int. Cl.

| | |
|---|---|
| ***F24F 13/10*** | (2006.01) |
| ***F24F 1/005*** | (2019.01) |
| ***F24F 1/0033*** | (2019.01) |
| ***F24F 13/068*** | (2006.01) |
| ***F24F 13/12*** | (2006.01) |
| *F24F 13/20* | (2006.01) |
| *F24F 1/0047* | (2019.01) |
| *F24F 1/0057* | (2019.01) |
| *F24F 1/0025* | (2019.01) |

(52) U.S. Cl.
CPC ..... *F24F 13/068* (2013.01); *F24F 13/10* (2013.01); *F24F 13/12* (2013.01); *F24F 1/0025* (2013.01); *F24F 1/0047* (2019.02); *F24F 1/0057* (2019.02); *F24F 13/20* (2013.01)

(58) Field of Classification Search
CPC ..... F24F 1/0057; F24F 1/0047; F24F 1/0025; F24F 13/20
USPC ..... 454/233
See application file for complete search history.

(56) References Cited

U.S. PATENT DOCUMENTS

2014/0000852 A1* 1/2014 Kim ..... F24F 7/007 165/121
2015/0192323 A1 7/2015 Lee

FOREIGN PATENT DOCUMENTS

| | | |
|---|---|---|
| CN | 103528131 | 1/2014 |
| CN | 103574775 | 2/2014 |
| DE | 41 24 850 A1 | 1/1993 |
| EP | 2290296 | 3/2011 |
| EP | 2518418 | 10/2012 |
| GB | 2378502 | 2/2003 |
| JP | 2004-176995 | 6/2004 |
| JP | 2012-93043 | 5/2012 |
| KR | 10-2013-0043983 | 5/2013 |
| KR | 10-2014-0019106 | 2/2014 |
| KR | 10-2014-0019207 | 2/2014 |
| KR | 10-2014-0037985 | 3/2014 |
| KR | 10-2014-0048363 | 4/2014 |
| KR | 10-1385292 | 4/2014 |
| KR | 10-1698842 | 1/2017 |
| WO | 2013/172709 | 11/2013 |

OTHER PUBLICATIONS

Korean Office Action dated Jul. 16, 2018 in Korean Patent Application No. 10-2018-0057364.
U.S. Office Action dated Nov. 28, 2018 in U.S. Appl. No. 15/433,044.
Liu, Haiting, CN202660642 Translation.pdf, "Split floor-type air conditioner capable of six-dimensionally supplying air", Jan. 2013, pp. 1-6.
Korean Office Action dated Oct. 19, 2018 in corresponding Korean Patent Application No. 10-2018-0057364.
Extended European Search Report dated Nov. 27, 2018 in corresponding European Patent Application No. 18166336.0.
U.S. Office Action dated Mar. 15, 2019 in U.S. Appl. No. 15/209,098.
European Communication dated Feb. 27, 2019 in European Patent Application No. 16828008.9.
Russian Notice of Allowance dated Mar. 27, 2019 in Russian Patent Application No. 2018101457.
Chinese Office Action dated Mar. 21, 2019 in Chinese Patent Application No. 201610565806.4.
Chinese Office Action dated Mar. 21, 2019 in Chinese Patent Application No. 201710462738.3.
Chinese Office Action dated Mar. 21, 2019 in Chinese Patent Application No. 201810343547.X.
Australian Notice of Allowance dated Jan. 14, 2019 in Australian Patent Application No. 2016297373.
Russian Office Action dated Oct. 16, 2018 in Russian Patent Application No. 2018101457/12.
International Search Report dated Oct. 19, 2016 in International Patent Application No. PCT/KR2016/007735.
Korean Office Action dated Aug. 17, 2016 in Korean Patent Application No. 10-2015-0101933.
Korean Notice of Allowance dated Oct. 27, 2016 in Korean Patent Application No. 10-2015-0101933.
Extended European Search Report dated Jul. 14, 2017 in European Patent Application No. 16828008.9.
Korean Notice of Allowance dated Jul. 25, 2017 in Korean Patent Application No. 10-2016-0179548.
Korean Office Action dated Mar. 8, 2017 in Korean Patent Application No. 10-2016-0179548.
U.S. Restriction Requirement dated May 5, 2017 in U.S. Appl. No. 15/433,044.
U.S. Office Action dated Aug. 25, 2017 in U.S. Appl. No. 15/433,044.
U.S. Office Action dated Mar. 22, 2018 in U.S. Appl. No. 15/433,044.
U.S. Appl. No. 15/209,098, filed Jul. 13, 2016, Hyun Joo Jeon, et al., Samsung Electronics Co., Ltd.
U.S. Appl. No. 15/433,044, filed Feb. 15, 2017, Hyun Joo Jeon, et al., Samsung Electronics Co., Ltd.
U.S. Office Action dated Sep. 7, 2018 in U.S. Appl. No. 15/209,098.
Kim, Jin Baek, KR20140037985 Translation.pdf, "Indoor unit of air conditioner", Mar. 2014, pp. 1-24.
U.S. Office Action dated Sep. 30, 2019 in U.S. Appl. No. 15/209,098.
U.S. Office Action dated Nov. 13, 2019 in U.S. Appl. No. 15/433,044.
U.S. Office Action dated Jun. 11, 2019 in U.S. Appl. No. 15/433,044.
Chinese Office Action dated Dec. 30, 2019 in Chinese Patent Application No. 201610565806.4.
Chinese Office Action dated Dec. 30, 2019 in Chinese Patent Application No. 201710462738.3.
Chinese Office Action dated Dec. 30, 2019 in Chinese Patent Application No. 201810343547.X.
European Communication dated Oct. 14, 2019 in European Patent Application No. 18166336.0.
European Communication dated Oct. 18, 2019 in European Patent Application No. 16828008.9.
U.S. Office Action dated Apr. 15, 2020 in U.S. Appl. No. 15/209,098.
U.S. Office Action dated May 11, 2020 in U.S. Appl. No. 15/433,044.
Indian Office Action dated Feb. 28, 2020 in Indian Patent Application No. 20187006033.
Chinese Office Action dated Apr. 7, 2020 in Chinese Patent Application No. 201710462738.3.
Chinese Office Action dated Apr. 7, 2020 in Chinese Patent Application No. 201610565806.4.
Chinese Office Action dated Jun. 17, 2020 in Chinese Patent Application No. 201811493794.4.
U.S. Office Action dated Jul. 30, 2020 in U.S. Appl. No. 15/209,098.
U.S. Advisory Action dated Jul. 23, 2020 in U.S. Appl. No. 15/433,044.
Brazilian Office Action dated Jul. 7, 2020 in Brazilian Patent Application No. BR112018000160-0.
U.S. Appl. No. 17/065,790, filed Oct. 8, 2020, Hyun Joo Jeon, Samsung Electronics Co., Ltd.
Korean Office Action dated Aug. 7, 2020 in Korean Patent Application No. 10-2016-0179550.
Chinese Office Action dated Oct. 19, 2020 in Chinese Patent Application No. 201610565806.4.
Chinese Office Action dated Oct. 19, 2020 in Chinese Patent Application No. 201710462738.3.
Chinese Office Action dated Oct. 19, 2020 in Chinese Patent Application No. 201810343547.X.

(56) References Cited

OTHER PUBLICATIONS

Korean Office Action dated Feb. 18, 2021 in Korean Patent Application No. 10-2016-0179550.
European Communication dated Feb. 1, 2021 in European Patent Application No. 18166336.0.

* cited by examiner

AIR CONDITIONER

CROSS-REFERENCE TO RELATED APPLICATIONS

This application is a continuation of U.S. patent application Ser. No. 15/209,098, filed on Jul. 13, 2016, which claims the priority benefit of Korean Patent Application No. 10-2015-0101933, filed on Jul. 17, 2015 in the Korean Intellectual Property Office, the disclosures of which are incorporated herein by reference.

BACKGROUND

1. Field

The following description relates to an air conditioner, and more particularly, to an air conditioner that discharges air using various methods.

2. Description of the Related Art

In general, an air conditioner refers to a device that adjusts temperature, humidity, airflow, and air distribution suitably for human activities by using a refrigeration cycle, and removes dust and the like contained in the air. The refrigeration cycle includes a compressor, a condenser, an evaporator, and a blower fan as main constituent elements.

Air conditioners may be classified into split-type air conditioners in which an indoor unit and an outdoor unit are separately installed and integrated-type air conditioners in which an indoor unit and an outdoor unit are installed together in one cabinet. An indoor unit of the split-type air conditioner includes a heat exchanger to perform heat exchange of air sucked into a panel and a blower fan to suck indoor air into the panel and blow the sucked air to an indoor room.

Indoor units of conventional air conditioners have been manufactured to minimize the heat exchanger and maximize wind speed and air volume by increasing revolutions per minute (RPM) of the blower fan. Accordingly, air discharge temperature decreases, and air is discharged to an indoor space through a long narrow flow path.

While direct contact with discharged air may cause chilliness and discomfort to users, a far distance from the discharged air may cause hot and unpleasant feelings.

In addition, when the RPM of the blower fan is increased to increase the wind speed, noise may be increased. A radiation air conditioner that conditions air without using a blower fan requires a larger panel to obtain the same air conditioning capabilities as an air conditioner using a blower fan. Also, the radiation air conditioner has a very low cooling speed and manufacturing costs thereof are very high.

SUMMARY

Additional aspects and/or advantages will be set forth in part in the description which follows and, in part, will be apparent from the description, or may be learned by practice of the disclosure.

Therefore, it is an aspect of the present disclosure to provide an air conditioner that discharges air using various methods.

It is an aspect of the present disclosure to provide an air conditioner that heats and cools indoor air at a minimum wind speed providing a pleasant and comfortable environment for a user.

It is an aspect of the present disclosure to provide an air conditioner that cools air via convection at a minimum wind speed and cools air via radiation through a cool air region formed in neighboring areas.

In accordance with an aspect of the present disclosure, an air conditioner includes: a housing comprising an external panel defining an external appearance and having an opening formed at the external panel; a heat exchanger configured to exchange heat with air flowing into the housing; and an air discharge unit configured to discharge air heat-exchanged by the heat exchanger out of the housing. The air discharge unit comprises: a first discharge unit connected to the opening and discharging air; and a second discharge unit provided at the external panel and discharging air.

The heat-exchanged air is selectively discharged through either the first discharge unit or the second discharge unit.

The air conditioner may further include a door unit configured to open and close the first discharge unit. A flow of heat-exchanged air is controlled to at least one of the first discharge unit and the second discharge unit by opening and closing the first discharge unit using the door unit.

The second discharge unit is provided at the external panel and has a plurality of discharge holes formed to penetrate inner and outer surfaces of the external panel.

The air conditioner may further include a guide opening unit disposed at the opening and forming the first discharge unit along an inner circumferential surface thereof.

The air discharge unit further includes a first discharge flow path through which the heat-exchanged air reaches the first discharge unit; a second discharge flow path through which the heat-exchanged air reaches the second discharge unit; and a discharge guide unit configured to flow the heat-exchanged air through at least one of the first discharge flow path and the second discharge flow path.

The discharge guide unit includes a guide body in which the first discharge flow path is formed; and a guide groove provided at the guide body and forming the second discharge flow path.

The air conditioner may further include a door unit configured to open and close the first discharge unit. When the first discharge unit is closed by the door unit, air flowing in the guide body is discharged through the second discharge unit via the guide groove.

The air discharge unit includes a first discharge flow path through which the heat-exchanged air reaches the first discharge unit; and a second discharge flow path through which the heat-exchanged air reaches the second discharge unit. The external panel comprises a discharge panel formed on at least one surface of the housing. The discharge panel includes a flow path forming frame; and a discharge plate disposed at an outer portion than the flow path forming frame and forming the second discharge flow path between the flow path forming frame and the discharge plate.

The second discharge unit comprises a discharge region having a plurality of through-holes penetrating inner and outer surfaces of the discharge plate distributed therein and formed in at least one region of the discharge plate.

The plurality of discharge holes is uniformly distributed in the discharge region.

The opening is disposed at the discharge plate.

The discharge guide unit comprises at least one of a mesh material and a porous material.

The discharge guide unit includes a first guide unit comprising a guide body forming the first discharge flow path and guide through-holes formed in the guide body and forming the second discharge flow path; and a second guide unit slidably movable with respect to the first guide unit to selectively open and close the guide through-holes.

The discharge guide unit includes a first guide unit comprising a guide body forming the first discharge flow path and guide through-holes formed in the guide body and forming the second discharge flow path; and a second guide unit slidably movable in a circumferential direction of the first guide unit to selectively open and close the guide through-holes.

In accordance with an aspect of the present disclosure, an air conditioner includes a housing having an opening; a heat exchanger configured to exchange heat with air flowing into the housing; a discharge unit configured to discharge air heat-exchanged by the heat exchanger through the opening; and a plate discharge unit comprising a discharge plate forming at least one portion of an external appearance of the housing and a plurality of discharge holes formed in the discharge plate, wherein air heat-exchanged by the heat exchanger is discharged through the plurality of discharge holes.

Air heat-exchanged by the heat exchanger is discharged through at least one of the discharge unit and the plate discharge unit.

The air conditioner may further include a door unit configured to open and close the discharge unit. A flow of heat-exchanged air is controlled to at least one of the discharge unit and the plate discharge unit by opening and closing the discharge unit using the door unit.

The air conditioner may further include a discharge guide unit configured to flow air heat-exchanged by the heat exchanger through at least one of the discharge unit and the plate discharge unit. The discharge guide unit includes a guide body configured to guide the heat-exchanged air to the discharge unit; and a guide groove formed in the guide body as a hole shape and configured to flow the heat-exchanged air to the plate discharge unit.

In accordance with an aspect of the present disclosure, an air conditioner includes a housing comprising a discharge panel having a plurality of discharge holes formed in the surface thereof and at least one opening formed at the discharge panel; a heat exchanger configured to exchange heat with air flowing into the housing; at least one discharge flow path formed from the heat exchanger and connected to the at least one opening; and a radial discharge flow path formed from the heat exchanger and connected to the plurality of discharge holes. The heat-exchanged air selectively flows through at least one of the discharge flow path and the radial discharge flow path.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
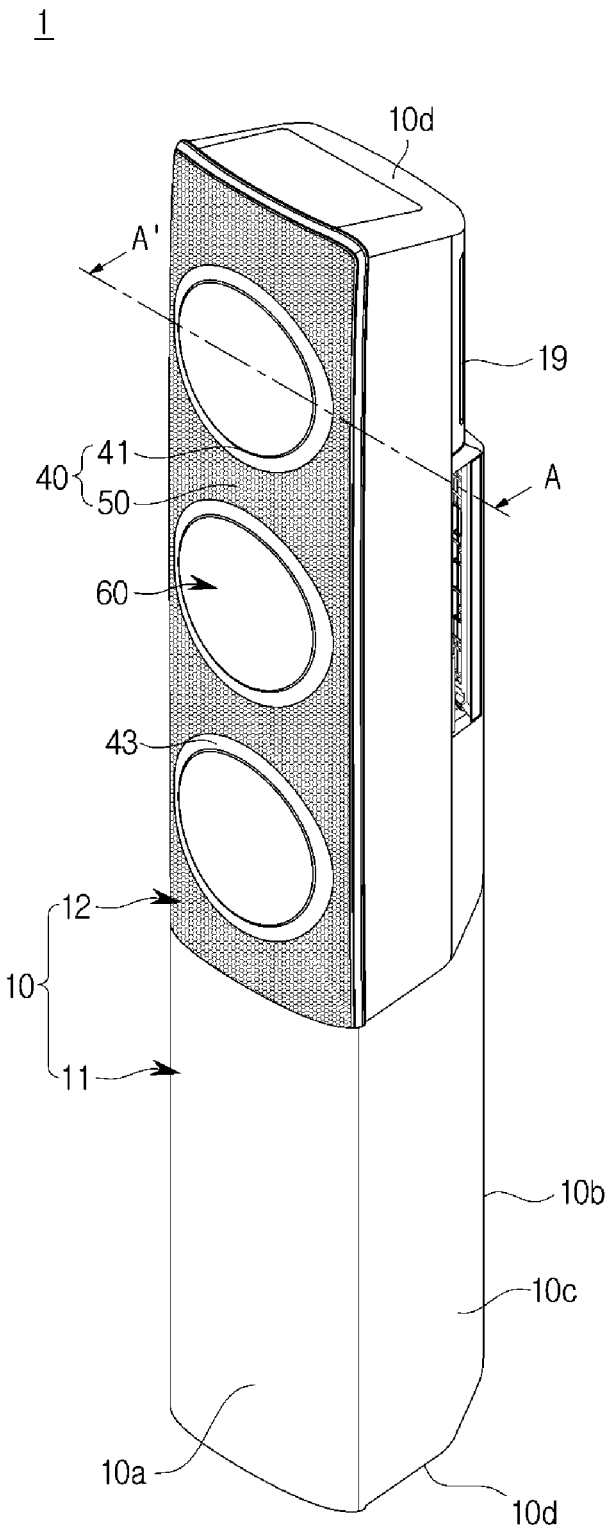
FIG. 1 is a perspective view illustrating an air conditioner 1 according to an embodiment of the present disclosure.

Reference will now be made in detail to the embodiments of the present disclosure, examples of which are illustrated in the accompanying drawings, wherein like reference numerals refer to like elements throughout.

The terms used in the present specification are merely used to describe particular embodiments, and are not intended to limit the present disclosure. An expression used in the singular encompasses the expression of the plural, unless it has a clearly different meaning in the context. In the present specification, it is to be understood that the terms such as "including" or "having," etc., are intended to indicate the existence of the features, numbers, operations, components, parts, or combinations thereof disclosed in the specification, and are not intended to preclude the possibility that one or more other features, numbers, operations, components, parts, or combinations thereof may exist or may be added.

It will be understood that, although the terms "first", "second", etc., may be used herein to describe various elements, these elements should not be limited by these terms. The above terms are used only to distinguish one component from another. For example, a first component discussed below could be termed a second component, and similarly, the second component may be termed the first component without departing from the teachings of this disclosure. As used herein, the term "and/or" includes any and all combinations of one or more of the associated listed items.

Hereinafter, embodiments of the present disclosure will be described in detail with reference to the accompanying drawings.

A refrigeration cycle of an air conditioner is performed by using a compressor, a condenser, an expansion valve, and an evaporator. The refrigeration cycle includes a series of processes involving compression, condensation, expansion, and evaporation, and supplies low-temperature air after exchanging heat between high-temperature air and a low-temperature refrigerant.

The compressor compresses and discharges a refrigerant gas in a high-temperature high-pressure state, and the discharged refrigerant gas is introduced into the condenser. The condenser condenses the compressed refrigerant into a liquid phase, and heat is discharged to the surroundings through the condensation process. The expansion valve expands the liquid phase refrigerant in the high-temperature and high-pressure state which is condensed by the condenser into a liquid phase in a low-pressure state. The evaporator evaporates the refrigerant expanded by the expansion valve. The evaporator achieves refrigeration effects via heat exchange with a material to be cooled using latent heat of the refrigerant and returns the refrigerant gas in a low-temperature and low pressure state to the compressor. Throughout this cycle, a temperature of indoor air may be controlled.

An outdoor unit of the air conditioner refers to a part of the refrigeration cycle including a compressor and an outdoor heat exchanger. The expansion valve may be provided in an indoor unit or outdoor unit, and an indoor heat exchanger is provided in an indoor unit of the air conditioner.

The present disclosure provides an air conditioner that cools an indoor space. An outdoor heat exchanger functions as a condenser, and the indoor heat exchanger functions as an evaporator. Hereinafter, an indoor unit including the indoor heat exchanger is referred to as an air conditioner, and the indoor heat exchanger is referred to as a heat exchanger for descriptive convenience.

FIG. 1 is a perspective view illustrating an air conditioner 1 according to an embodiment of the present disclosure.

An indoor unit of the air conditioner 1 includes a housing 10 having at least one opening 17 and defining an appearance thereof, a heat exchanger 20 configured to exchange heat with air flowing into the housing 10, an air blower unit 30 configured to circulate air into or out of the housing 10, and an air discharge unit 40 configured to discharge air blown from the air blower unit 30 out of the housing 10.

The housing 10 includes a front panel 10*a* having at least one opening 17, a rear panel 10*b* disposed at the rear of the front panel 10*a*, side panels 10*c* disposed between the front panel 10*a* and the rear panel 10*b*, and upper and lower panels 10*d* disposed at upper and lower parts of the side panels 10*c*. At least two openings 17 having a circular shape may be arranged to be spaced apart from each other in a lengthwise direction of the front panel 10*a*. The rear panel 10*b* may be provided with a suction unit 19 such that external air is sucked into the housing 10.

The suction unit 19 is arranged at the rear panel 10*b* disposed at a rear side of the heat exchanger 20 to guide air outside the housing 10 into the housing 10. The air flowing into the housing 10 through the suction unit 19 absorbs or loses heat while passing through the heat exchanger 20. Heat-exchanged air while passing through the heat exchanger 20 is discharged out of the housing 10 via a discharge unit by the air blower unit 30.

The air blower unit 30 may include a blower fan 32 and a grille 34.

The grille 34 may be arranged in an air discharge direction of the blower fan 32. Although a mixed flow fan is used as the blower fan 32 according to this embodiment, types of the blower fan 32 are not limited thereto and the blower fan 32 may have any structure so long as external air flowing into the housing 10 is discharged out of the housing 10. For example, the blower fan 32 may be a crossflow fan, a turbo fan, or a sirocco fan. Although the number of the blower fan 32 is not limited, at least one blower fan 32 may be provided to correspond to the at least one opening according to the present embodiment. The blower fan 32 is disposed in front of the suction unit 19, and the heat exchanger 20 may be disposed between the blower fan 32 and the suction unit 19. A first discharge unit 41 may be disposed in front of the blower fan 32.

The air blower unit 30 may include a fan drive unit 33 disposed at the center of the blower fan 32 and used to drive the blower fan 32. The fan drive unit 33 may include a motor.

The grille 34 is arranged in front of the blower fan 32 to guide an air flow. In addition, the grille 34 may be disposed between the blower fan 32 and the air discharge unit 40 to minimize external influences applied to the blower fan 32.

The grille 34 may include a plurality of wings 35. The plurality of wings 35 may adjust a blowing direction or volume of air blown from the blower fan 32 toward the air discharge unit 40 by adjusting the number, shape, and alignment angle thereof.

A door operating unit 66, which will be described later, may be disposed at the center of the grille 34. The door operating unit 66 and the fan drive unit 33 may be aligned in a straight line in a forward/backward direction. According to this structure, a plurality of wings 35 of the grille 34 may be arranged in front of wings of the blower fan 32.

The air blower unit 30 may include a duct 36. The duct 36 may have a cylindrical shape surrounding the blower fan 32 to guide an air flow into the blower fan 32. That is, air sucked through the suction unit 19 and having passed through the heat exchanger 20 is guided into the blower fan 32.

The heat exchanger 20 may be arranged between the blower fan 32 and the suction unit 19 to absorb heat from air sucked through the suction unit 19 or transfer heat to the sucked through the suction unit 19. The heat exchanger 20 may include a tube 21 and headers 22 coupled to upper and lower sides of the tube 21. However, types of the heat exchanger 20 are not limited.

At least one heat exchanger 20 may be disposed in the housing 10 such that the number of the heat exchanger 20 corresponds to that of the opening.

The air discharge unit 40 is provided in the housing 10 such that air heat-exchanged in the housing 10 is discharged out of the housing 10. The air discharge unit 40 includes the first discharge unit 41 and a second discharge unit 50, which will be described later.

Figure 2:
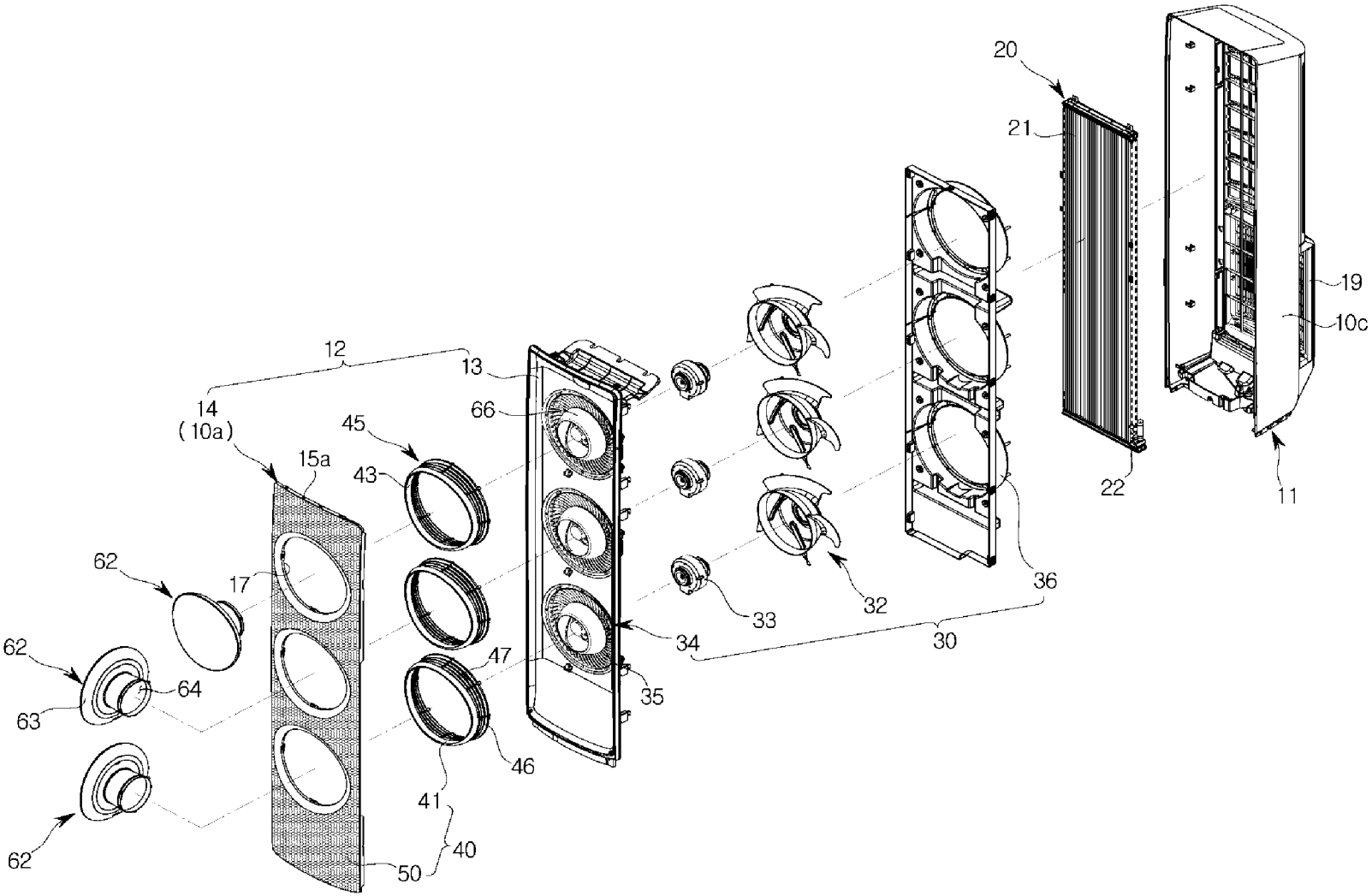
FIGS. 2 and 3 are exploded perspective views of the air conditioner according to the embodiment.
Figure 3:
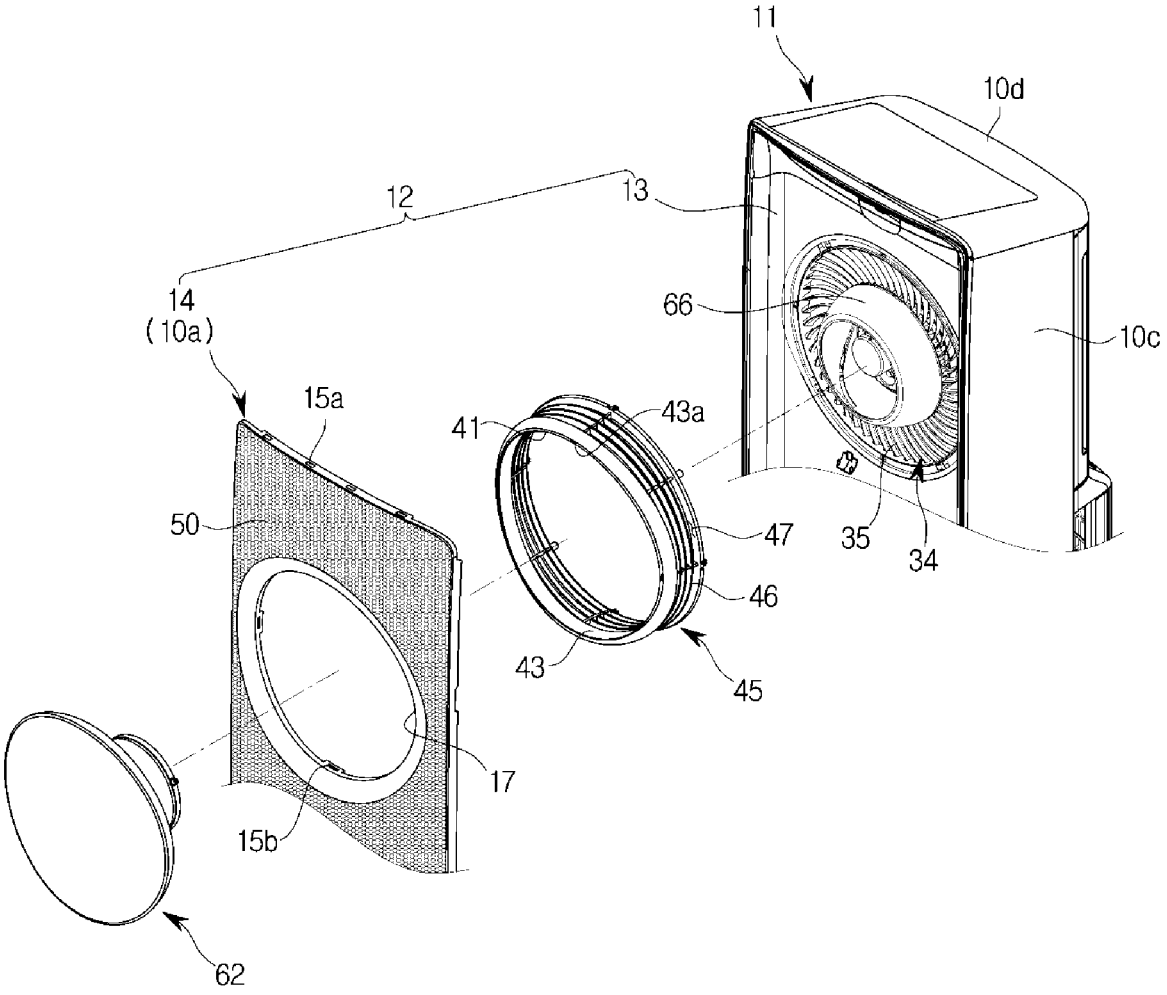
Figure 4:
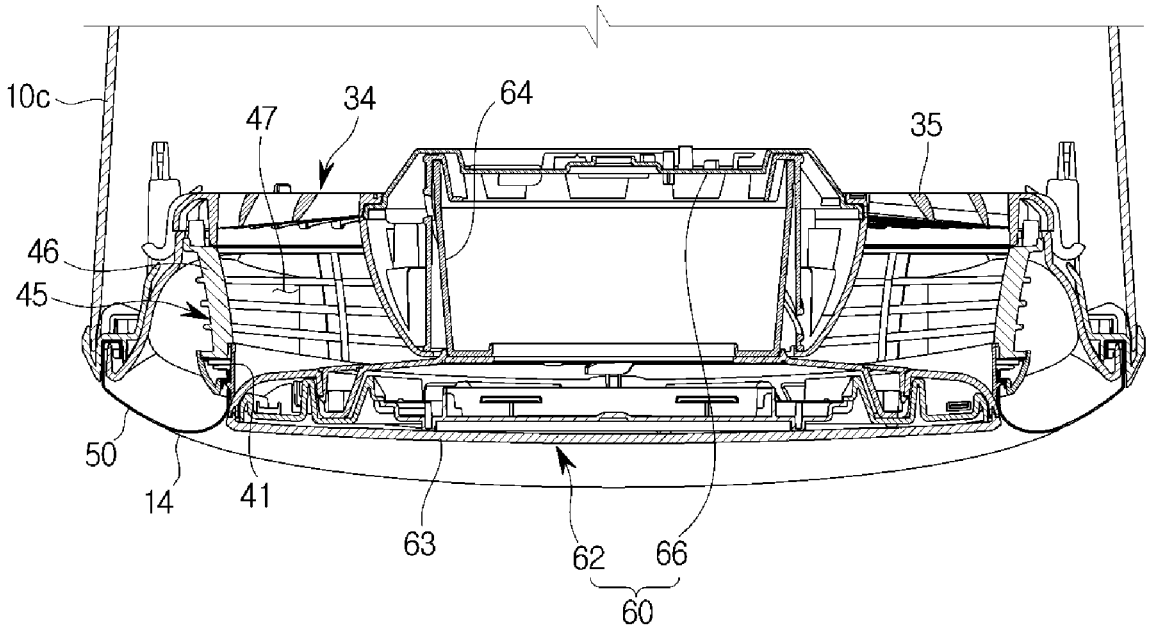
FIG. 4 is a cross-sectional view taken along line A-A' of FIG. 1.

FIGS. 2 and 3 are exploded perspective views of the air conditioner according to the embodiment. FIG. 4 is a cross-sectional view taken along line A-A' of FIG. 1.

The air conditioner 1 may operate in a plurality of operation modes. The plurality of operation modes may include a first mode in which heat-exchanged air is discharged through the opening 17 provided in the housing 10 and a second mode in which heat-exchanged air is discharged through a discharge plate 14 provided in the housing 10. The operation modes may also include a third mode in which heat-exchanged air is discharged through both the opening 17 and the discharge plate 14. The discharge plate 14 will be described later.

The first mode, the second mode, and the third mode are configured such that heat-exchanged air is discharged respectively through the first discharge unit 41, the second discharge unit 50, and both the first discharge unit 41 and the second discharge unit 50 which will be described later. That is, air heat-exchanged by the heat exchanger 20 may be discharged out of the air conditioner 1 through the first discharge unit 41 and the second discharge unit 50 by the blower fan 32.

Although heat-exchanged air is discharged through the first discharge unit 41 in the first mode, all of the heat-exchanged air may not be discharged through the first discharge unit 41. Instead, heat-exchanged air may also be partially discharged through the second discharge unit 50. In other words, the first mode may be configured such that most of the heat-exchanged air is discharged through the first discharge unit 41. In the same manner as in the first mode, the second mode may be configured such that most of the heat-exchanged air is discharged through the second discharge unit 50.

Air having passed through the air blower unit 30 may be discharged out of the housing 10 through the air discharge unit 40.

The air discharge unit 40 may include the first discharge unit 41 and the second discharge unit 50. Heat-exchanged air may be discharged through at least one of the first discharge unit 41 and the second discharge unit 50. Furthermore, heat-exchanged air may be discharged selectively through either the first discharge unit 41 or the second discharge unit 50.

The first discharge unit 41 is configured to discharge air through the opening provided at the housing 10. When the air conditioner 1 is in the first mode, heat-exchanged air is discharged out of the housing 10 through the first discharge unit 41. The first discharge unit 41 is configured such that heat-exchanged air is directly discharged to the outside. The first discharge unit 41 may be exposed to the outside of the housing 10.

The first discharge unit 41 may be arranged in an air blowing direction of the blower fan 32 such that heat-exchanged air is directly discharged to the outside. That is, the first discharge unit 41 may be disposed in front of the blower fan 32 of the air blower unit 30 such that the air blown from the air blower unit 30 is directly discharged through the first discharge unit 41.

Air blown from the blower fan 32 may flow through a first discharge flow path 41*a* (refer to FIG. 9) arranged between the blower fan 32 and the first discharge unit 41. The first discharge flow path 41*a* may be defined by a discharge guide unit 45.

The first discharge unit 41 may be formed by a guide opening unit 43. The guide opening unit 43 may be connected to the opening 17 and may be provided to form the first discharge unit 41 along an inner circumferential surface thereof. The guide opening unit 43 is exposed to the outside via the opening 17 of the housing 10 and a door unit 60, which will be described later, may be moved to be mounted to the guide opening unit 43. The guide opening unit 43 may be arranged in the opening 17 of the housing 10 and form the first discharge unit 41 along the inner circumferential surface thereof.

The first discharge unit 41 may be opened and closed by the door unit 60.

The door unit 60 opens and closes the first discharge unit 41, and heat-exchanged air is discharged to the outside of the housing 10 selectively through the first discharge unit 41. Heat-exchanged air may flow into at least one of the first discharge unit 41 and the second discharge unit 50 by opening and closing the first discharge unit 41.

The door unit 60 is moved between a door open position 60*a* (refer to FIGS. 8 and 9) in which the first discharge unit 41 is opened and a door closed position 60*b* (refer to FIGS. 10 and 11) in which the first discharge unit 41 is closed. The door unit 60 may be configured to move between the door open position 60*a* and the door closed position 60*b* in the forward/backward direction.

More particularly, the door unit 60 may include a door blade 62 and a door operating unit 66 configured to operate the door blade 62.

The door blade 62 may be formed in a circular shape to correspond to the shape of the first discharge unit 41. When the door unit 60 is located at the door open position 60*a*, the door blade 62 is spaced apart from the guide opening unit 43. When the door unit 60 is in the door closed position 60*b*, the door blade 62 is brought into contact with the guide opening unit 43 to close the first discharge unit 41.

The door blade 62 may include a blade body 63 having a circular shape to correspond to the shape of the first discharge unit 41 and a blade coupling unit 64 extending from the blade body 63 and coupled to the door operating unit 66.

The blade body 63 may be provided in a plate form with an almost circular shape. In addition, the blade body 63 may be configured such that one surface thereof faces the outside of the housing 10 and the other surface faces the air blower unit 30.

A display may be provided at the one surface of the blade body 63 such that an operating state of the air conditioner 1 is displayed thereon or the air conditioner 1 may be manipulated thereby.

The door operating unit 66 may be configured to move the door blade 62. The door operating unit 66 may include a motor (not shown). The door operating unit 66 may be coupled to the blade coupling unit 64 of the door blade 62 to move the door blade 62.

The aforementioned grille 34 may be arranged around the door operating unit 66. Air blown from the blower fan 32 disposed at the rear side of the grille 34 may be discharged forward after passing through the grille 34.

The second discharge unit 50 is configured to discharge air through an external panel. When the air conditioner 1 is in the second mode, heat-exchanged air is discharged to the outside of the housing 10 through the second discharge unit 50. Through this configuration, heat-exchanged air may be discharged to the outside with a reduced wind speed. The second discharge unit 50 is formed in the discharge plate 14, which will be described later, and may have a plurality of discharge holes penetrating inner and outer surfaces of the discharge plate 14. The opening 17 of the housing 10 may be arranged at the discharge plate 14 as illustrated in FIGS. 2 to 4, without being limited thereto. That is, for example, the opening 17 and the discharge plate 14 may be disposed at different surfaces of the housing 10.

When heat-exchanged air is discharged out of the housing 10 through the second discharge unit 50, air blown by the blower fan 32 may flow through the second discharge flow path 50*a* formed between the blower fan 32 and the second discharge unit 50. The second discharge flow path 50*a* may be formed by the discharge guide unit 45 and a discharge panel 12, which will be described later.

The external panel may include an appearance panel 11 defining an appearance thereof and the discharge panel 12 configured to discharge heat-exchanged air. Although the discharge panel 12 is a constituent element of the external panel, it may also be a constituent element of the discharge unit.

The discharge panel 12 is configured to form the second discharge flow path 50*a*. Heat-exchanged air may be discharged out of the air conditioner 1 through the second discharge flow path 50*a* formed by the discharge panel 12 and a discharge plate 14, which will be described later, at low speed.

Although the structure in which the discharge panel 12 is disposed on the front surface of the air conditioner 1 has been described as illustrated in FIGS. 1, 2, and 3 according to the present embodiment, the present disclosure is not limited thereto. That is, the discharge panel 12 may also be disposed on at least one surface selected from the group consisting of the front surface, right side surface, left side surface, rear surface, and upper surface of the air conditioner 1.

The discharge panel 12 may include a flow path forming frame 13 and the discharge plate 14.

The flow path forming frame 13 may separate the inside of the housing 10 from the second discharge flow path 50*a*. Heat-exchanged air may not flow into the housing 10 again by the flow path forming frame 13. According to the present embodiment, the flow path forming frame 13 extends from the grille 34 to be connected to the appearance panel 11.

The second discharge unit 50 may be formed in the discharge plate 14. The discharge plate 14 and the second discharge unit 50 may be referred to as a plate discharge unit.

Although the shape of the second discharge unit 50 is not limited, it may have a plurality of discharge holes according to the present embodiment. The second discharge unit 50 may be configured to penetrate the front and rear surfaces of the discharge plate 14. The discharge plate 14 is disposed at an outer portion than the flow path forming frame 13 to form the second discharge flow path 50*a* between the flow path forming frame 13 and the discharge plate 14.

The second discharge unit 50 may have a discharge region formed in at least one portion of the discharge plate 14. A plurality of discharge holes may be uniformly distributed in the discharge region or concentrated at one portion thereof. According to the present embodiment, a plurality of discharge holes is uniformly distributed in the discharge region.

The discharge region may be formed in at least one portion of the discharge plate 14. However, the present disclosure is not limited thereto, and the discharge region may be formed throughout the entire surface of the discharge plate 14.

The third mode is a mode in which heat-exchanged air is distributed and discharged through both the first discharge unit 41 and the second discharge unit 50. Distributed volumes of the heat-exchanged air into the respective discharge units may be determined by settings and controlled by a controller.

The air discharge unit 40 may include the first discharge flow path 41*a* through which heat-exchanged air flows into the first discharge unit 41 and the second discharge flow path 50*a* through which heat-exchanged air flows into the second discharge unit 50. The first discharge flow path 41*a* and the second discharge flow path 50*a* may be referred to as a discharge flow path and a radial discharge flow path, respectively.

Air blown by the blower fan 32 may flow through at least one of the first discharge flow path 41*a* and the second discharge flow path 50*a*.

In the first mode, air blown by the blower fan 32 may flow through the first discharge flow path 41*a* formed between the blower fan 32 and the first discharge unit 41. In addition, in the second mode, air blown by the blower fan 32 may flow through the second discharge flow path 50*a* formed between the blower fan 32 and the second discharge unit 50.

The air discharge unit 40 may include the discharge guide unit 45. Air blown by the blower fan 32 may be controlled by the discharge guide unit 45. The discharge guide unit 45 may be disposed in front of the air blower unit 30 such that air flowing from the air blower unit 30 flows through at least one of the first discharge flow path 41*a* and the second discharge flow path 50*a*.

The discharge guide unit 45 may include a guide body 46 and a guide groove 47.

The guide body 46 is configured to form the first discharge flow path 41*a* therein. The guide body 46 may have a cylindrical shape with a hollow area. More particularly, the guide body 46 may have a tubular shape having one side facing the air blower unit 30 and the other side facing the first discharge unit 41.

The guide groove 47 is formed such that the second discharge flow path 50*a* passes thereby. The guide groove 47 may be formed at the guide body 46. The shape of the guide groove 47 is not limited, and the guide groove 47 may have any shape disposed at the guide body 46 and enabling air to flow in an outward direction of the guide body 46. According to the present embodiment, the guide groove 47 may be formed to have a plurality of holes arranged along the circumference of the guide body 46.

In the first mode, the door unit 60 opens the first discharge unit 41. In this case, air blown from the air blower unit 30 passes through the first discharge flow path 41*a* formed inside the guide body 46 to be discharged through the first discharge unit 41.

In the second mode, the door unit 60 closes the first discharge unit 41. In this case, one side of the guide body 46 is blocked by the door unit 60, and air blown from the air blower unit 30 passes by the guide groove 47 formed at the guide body 46 to be discharged through the second discharge unit 50.

Figure 5:
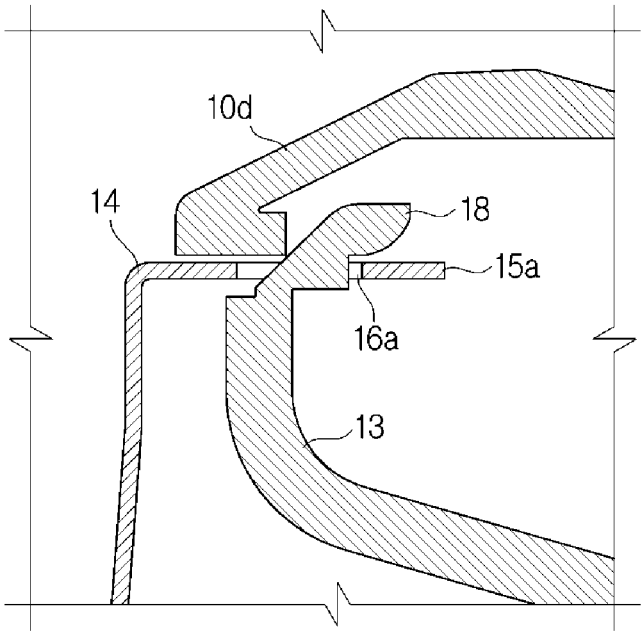
FIG. 5 is a view illustrating coupling between the discharge plate and the housing according to the embodiment.
Figure 6:
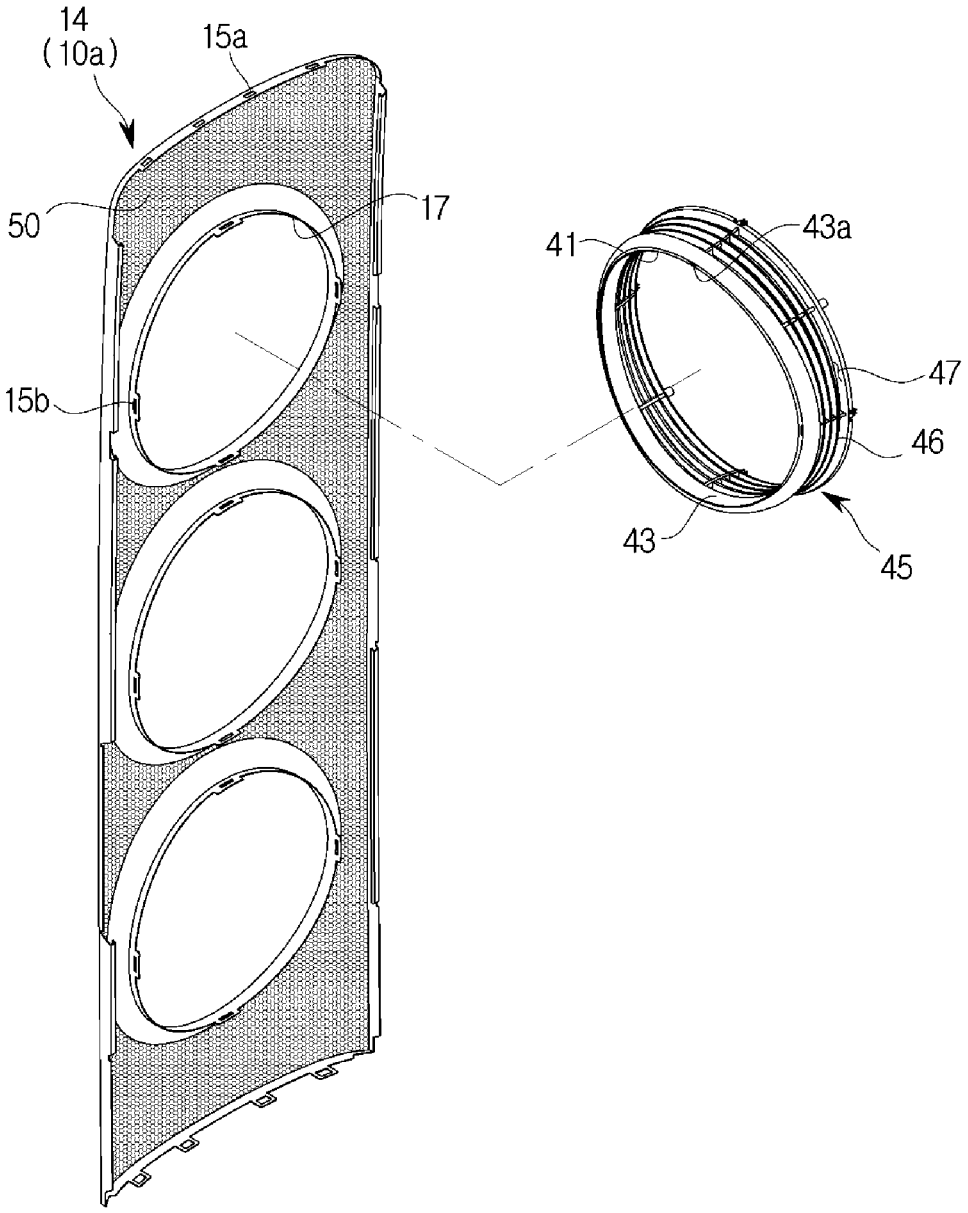
FIGS. 6 and 7 are views illustrating coupling between the discharge plate and the guide opening unit according to the embodiment.
Figure 7:
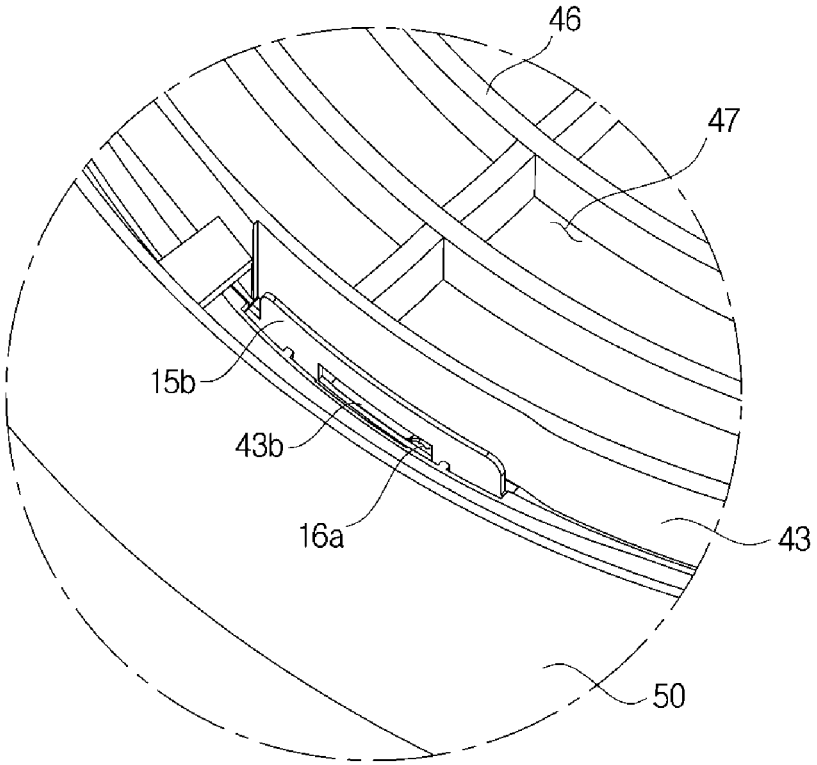

FIG. 5 is a view illustrating coupling between the discharge plate and the housing according to the embodiment. FIGS. 6 and 7 are views illustrating coupling between the discharge plate and the guide opening unit according to the embodiment.

The discharge plate 14 may include plate coupling units 15*a* and 15*b*. The plate coupling units 15*a* and 15*b* are configured such that the discharge plate 14 is coupled to the housing 10 or the guide opening unit 43.

The plate coupling unit 15*a* may be formed along outer edges of the discharge plate 14 to be coupled with the housing 10. Also, the plate coupling unit 15*b* may be formed along outer edges of the opening 17 of the discharge plate 14 to be coupled with the guide opening unit 43.

The plate coupling units 15*a* and 15*b* may protrude from the discharge plate 14. The plate coupling units 15*a* and 15*b* may have plate-holding grooves 16*a* and 16*b* having a hole shape, and the plate-holding grooves 16*a* and 16*b* may be hooked by holding protrusions 18 and 43*b*, which will be described later.

The plate coupling units 15*a* and 15*b* may include the first plate coupling unit 15*a* by which the discharge plate 14 is coupled to the housing 10 and the second plate coupling unit 15*b* by which the discharge plate 14 is coupled to the guide opening unit 43.

At least one first plate coupling unit 15*a* may be arranged along the outer edges of the discharge plate 14. The first plate coupling unit 15*a* is coupled to the housing 10 such that the housing 10 is coupled to the discharge plate 14.

The first holding protrusion 18 may be disposed at a position of the housing 10 corresponding to the first plate coupling unit 15*a*. According to the present embodiment, the first holding protrusion 18 is disposed at outer edges of the flow path forming frame 13 to correspond to the first plate coupling unit 15*a*. However, arrangement of the first holding protrusion 18 is not limited thereto, and the first holding protrusion 18 may be disposed at the housing 10 to correspond to the first plate coupling unit 15*a* to couple the housing 10 with the discharge plate 14.

As illustrated in FIG. 5, when the discharge plate 14 is brought into close contact with the housing 10, a first plate-holding groove 16*a* of the first plate coupling unit 15*a* is hooked by the first holding protrusion 18. Accordingly, the discharge plate 14 may be mounted to the housing 10.

The numbers of the first plate coupling unit 15*a* and the first holding protrusion 18 are not limited.

At least one second plate coupling unit 15*b* may be arranged along the outer edges of the opening 17. The second plate coupling unit 15*b* is coupled to the guide opening unit 43 such that the guide opening unit 43 is coupled to the discharge plate 14.

The guide opening unit 43 may have a guide insert groove 43*a* into which the second plate coupling unit 15*b* is inserted. When the discharge plate 14 is brought into close contact with the guide opening unit 43, the second plate coupling unit 15*b* may be inserted into the guide opening unit 43 via the guide insert groove 43*a*. The guide insert groove 43*a* may be arranged along the circumference of the guide opening unit 43 to correspond to the second plate coupling unit 15*b* disposed at the outer edges of the opening 17.

The second plate coupling unit 15*b* is inserted into the guide insert groove 43*a*, and the inserted second plate coupling unit 15*b* may couple the discharge plate 14 with the guide opening unit 43 as a second holding protrusion 43*b* is hooked by a second plate-holding groove 16*b* as illustrated in FIG. 7. As such, the opening 17 may be connected to the first discharge unit 41 by coupling the discharge plate 14 with the guide opening unit 43.

Although the numbers of the second plate coupling unit 15*b*, the second holding protrusion 43*b*, and the guide insert groove 43*a* are not limited, four of each arranged at predetermined distances are illustrated according to the present embodiment.

Hereinafter, operation of the air conditioner according to the present disclosure will be described.

FIGS. 8, 9, 10, and 11 are views illustrating operation of the air conditioner according to the embodiment.

Heat of external air flowing into the housing 10 is exchanged by the heat exchanger 20. Air conditioned by the heat exchanger 20 is discharged out of the housing 10 by the air blower unit 30.

The air conditioner 1 discharges air conditioned by the heat exchanger 20 to the outside through at least one of the first discharge unit 41 and the second discharge unit 50. That is, concentrated air conditioning may be performed through the first discharge unit 41 as in the first mode. Alternatively, air conditioning may be slowly performed throughout the entire room by discharging air through the second discharge unit 50 as in the second mode.

The first discharge unit 41 may be opened or closed by operating the door unit 60. When the first discharge unit 41 is opened, heat-exchanged air is discharged through the first discharge unit 41. When the first discharge unit 41 is closed, heat-exchanged air is discharged through the second discharge unit 50.

The first mode will be described in detail.

Figure 8:
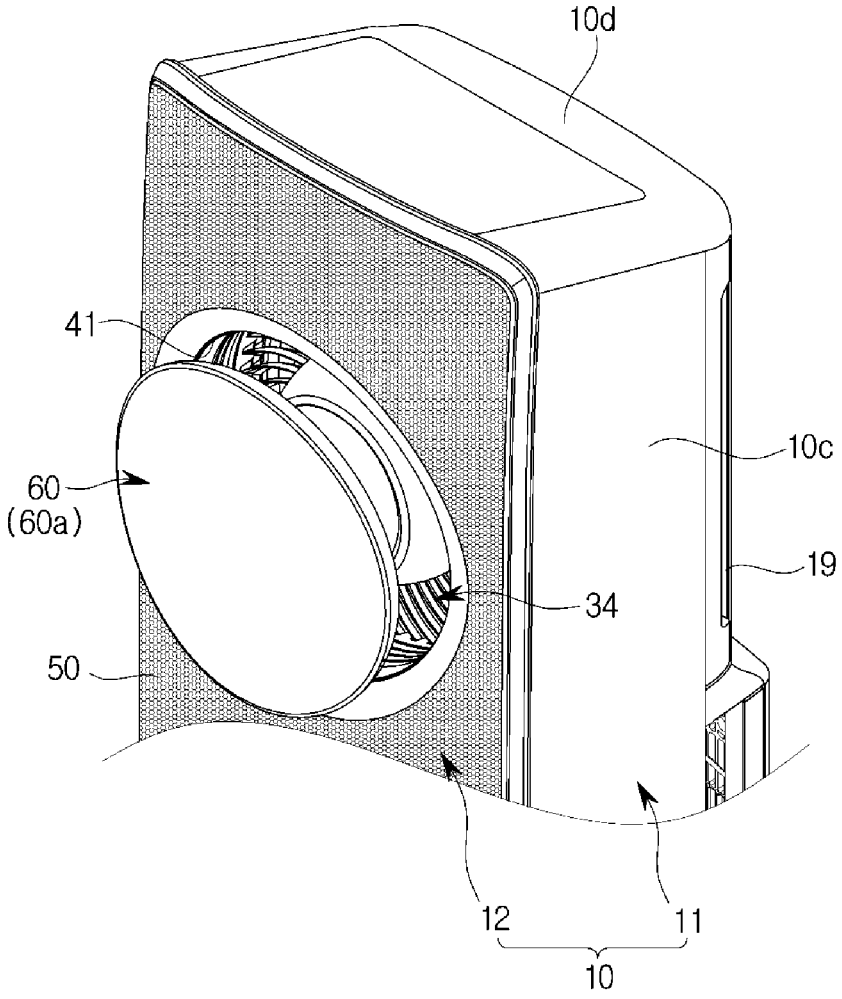
FIGS. 8, 9, 10, and 11 are views illustrating operation of the air conditioner according to the embodiment.
Figure 9:
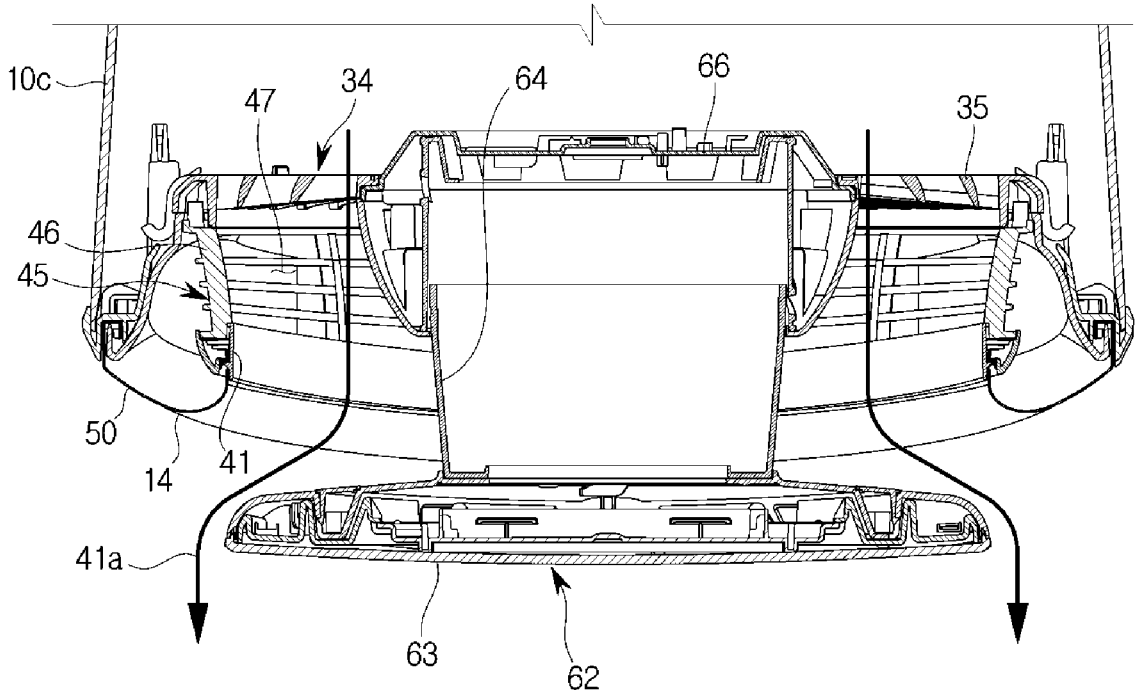

FIGS. 8 and 9 illustrate the air conditioner operating in the first mode.

In the first mode, heat-exchanged air is discharged through the first discharge unit 41. In the first mode, the door unit 60 is located at the door open position 60*a*, and the door blade 62 is spaced apart from the guide opening unit 43, thereby opening the first discharge unit 41.

In this case, air flowing from the air blower unit 30 flows toward the first discharge unit 41 through the first discharge flow path 41*a* formed by the guide body 46.

When discharged out of the housing 10 through the first discharge unit 41, air is discharged to the outside at a wind speed obtained by the air blower unit 30.

Then, the second mode will be described.

Figure 10:
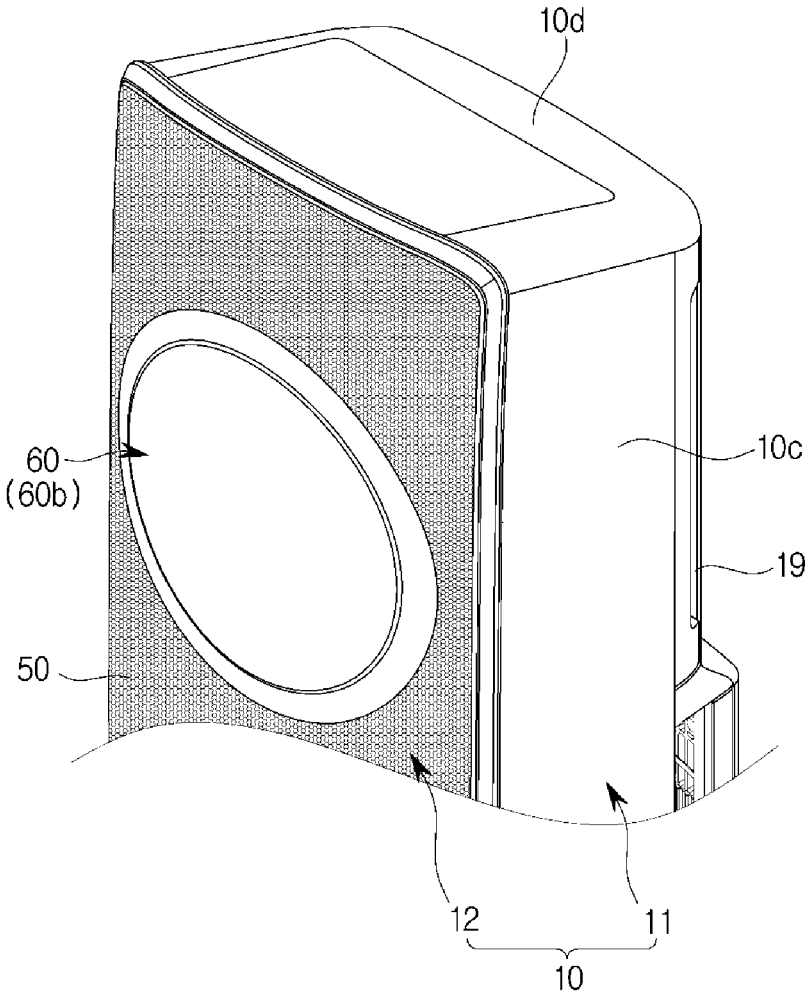
Figure 11:
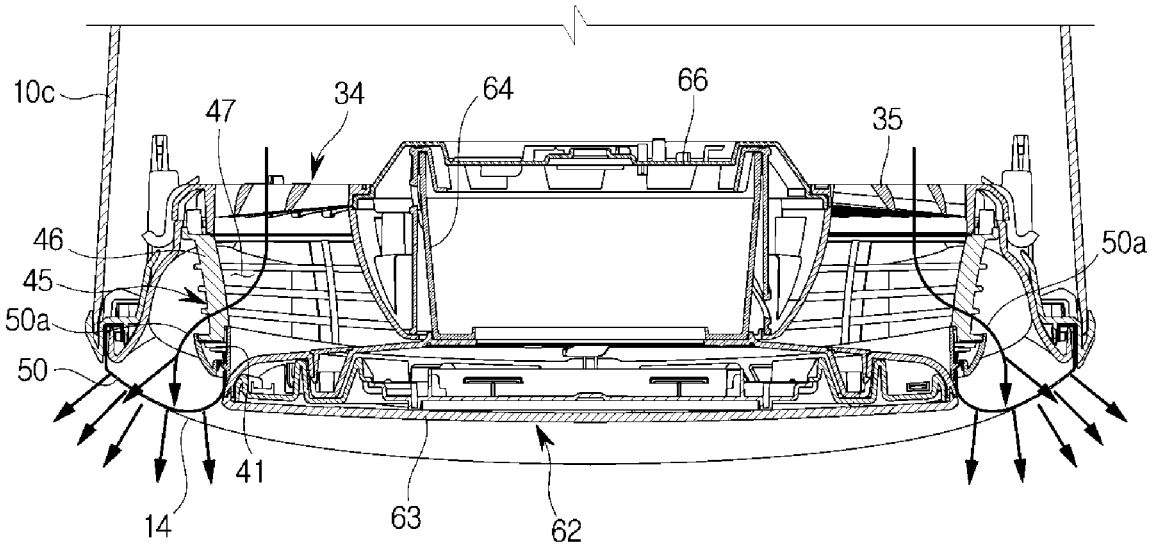

FIGS. 10 and 11 illustrate the air conditioner operating in the second mode.

In the second mode, heat-exchanged air is discharged through the second discharge unit 50. In the second mode, the door unit 60 is located at the door closed position 60*b*, and the door blade 62 is brought into contact with the guide opening unit 43 to close the first discharge unit 41.

In this case, air flowing from the air blower unit 30 passes through the guide groove 47 formed at the guide body 46 because the first discharge unit 41 is blocked by the door blade 62. Accordingly, air flowing from the air blower unit 30 flows toward the second discharge unit 50 after passing through the second discharge flow path 50*a*.

If air is discharged out of the housing 10 through the second discharge unit 50, the wind speed of air is reduced while passing through a plurality of discharge holes. Thus, air is discharged to the outside at a low wind speed.

According to this configuration, indoor air may be cooled or heated at a wind speed that is pleasant and comfortable for a user.

In the aforementioned descriptions, the first discharge unit 41 and the second discharge unit 50 may also be referred to as a high-speed discharge unit and a low-speed discharge unit, respectively.

Then, the third mode will be described.

The third mode is a mode in which heat-exchanged air is distributed into the first discharge unit 41 and the second discharge unit 50 to be discharged out of the housing 10. Volumes of distributed air into each discharge unit may be controlled by settings or the controller. Also, the distributed volumes may be controlled by surrounding environment by using a temperature sensor.

Hereinafter, an air conditioner according to an embodiment of the present disclosure will be described.

In this regard, descriptions presented above will not be repeated herein.

Figure 12:
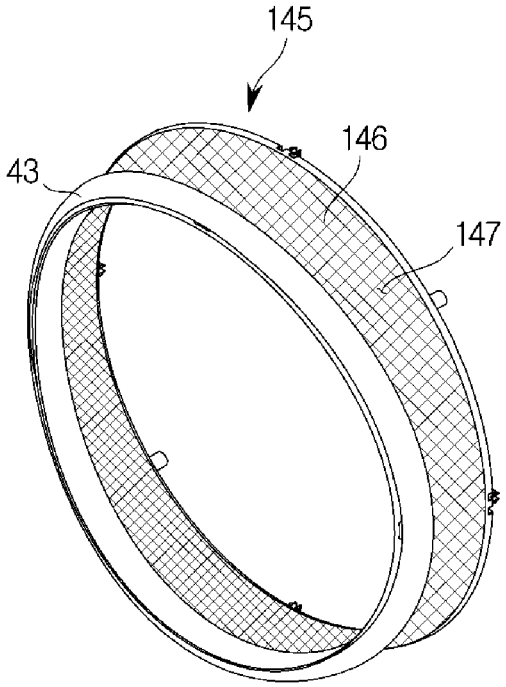
FIG. 12 is a perspective view illustrating a discharge guide unit according to an embodiment.

FIG. 12 is a perspective view illustrating a discharge guide unit according to an embodiment.

A discharge guide unit 145 may be disposed in front of the air blower unit 30 such that air flowing from the air blower unit 30 flows through at least one of the first discharge flow path 41*a* and the second discharge flow path 50*a*.

The discharge guide unit 145 may be formed of at least one of a mesh material and a porous material.

The discharge guide unit 145 may include a guide body 146 and a guide groove 147.

The guide body 146 is configured to form the first discharge flow path 41*a* therein. The guide body 146 may have a cylindrical shape with a hollow area. More particularly, the guide body 146 may have a tubular shape having one side facing the air blower unit 30 and the other side facing the first discharge unit 41.

The guide groove 147 is formed such that the second discharge flow path 50*a* passes thereby. The guide groove 147 may be formed at the guide body 146. The shape of the guide groove 147 is not limited, and the guide groove 147 may have any shape disposed at the guide body 146 and enabling air to flow in an outward direction of the guide body 146. Because the discharge guide unit 145 is formed of a mesh or porous material according to the present embodiment, the guide groove 147 may be a porous portion formed at the guide body 146.

Hereinafter, an air conditioner according to an embodiment of the present disclosure will be described.

In this regard, descriptions presented above will not be repeated herein.

FIGS. 13, 14, 15, and 16 are views illustrating a discharge guide unit according to an embodiment.

A discharge guide unit 245 includes a first guide unit 246 and a second guide unit 247.

The first guide unit 246 may include a guide body 246*a* and a guide groove 246*b*.

The guide body 246*a* may have a cylindrical shape with a hollow area. More particularly, the guide body 246 may have a tubular shape having one side facing the air blower unit 30 and the other side facing the first discharge unit 41.

The guide groove 246*b* may be formed at the guide body 246*a*. The shape of the guide groove 246*b* is not limited. The guide groove 246*b* may have any shape disposed at the guide body 246*a* and enabling air to flow therein. The guide groove 246*b* may be formed to have a plurality of holes arranged along the circumference of the guide body 246*a* according to the present embodiment.

The second guide unit 247 may be slidably moved with respect to the first guide unit 246. Particularly, the second guide unit 247 may be slidably moved in the forward/backward direction with respect to the first guide unit 246. The second guide unit 247 may have a cylindrical shape with a hollow area.

Figure 13:
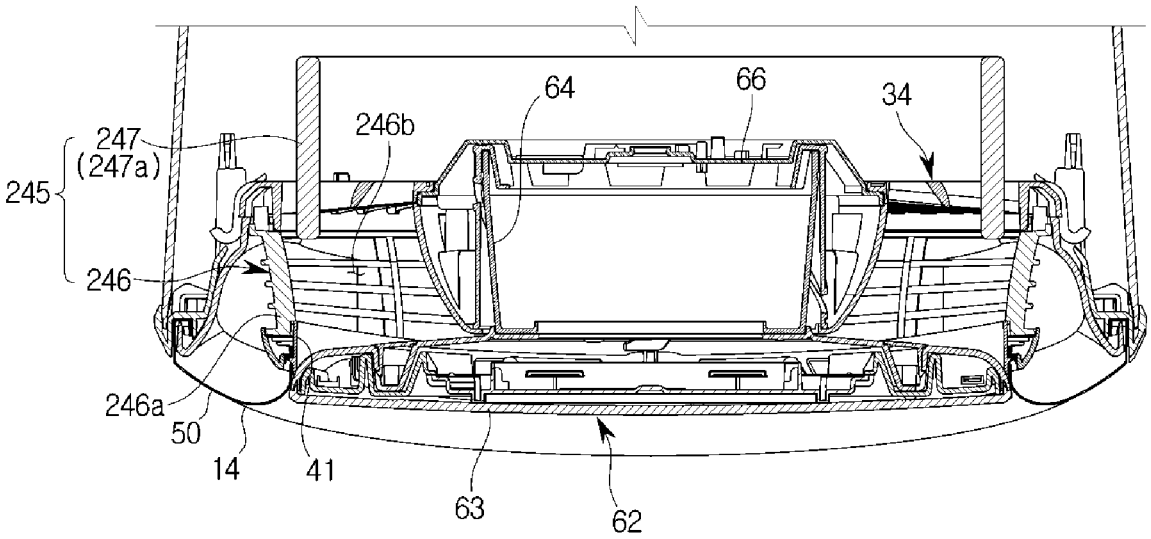
FIGS. 13, 14, 15, and 16 are views illustrating a discharge guide unit according to an embodiment.
Figure 14:
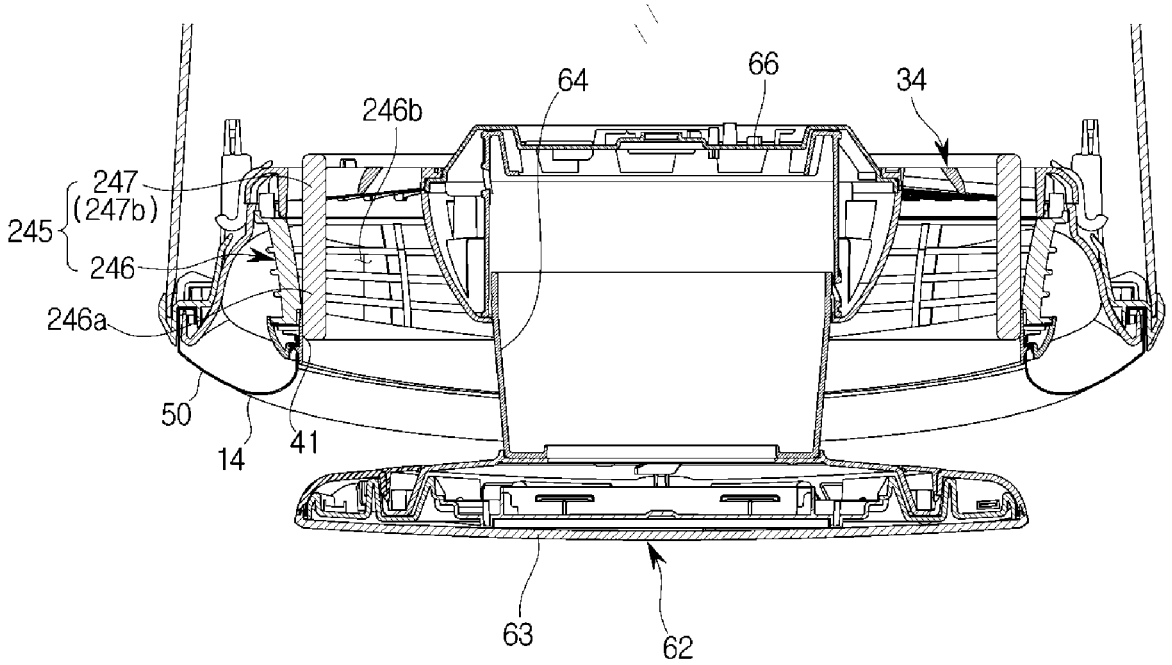
Figure 15:
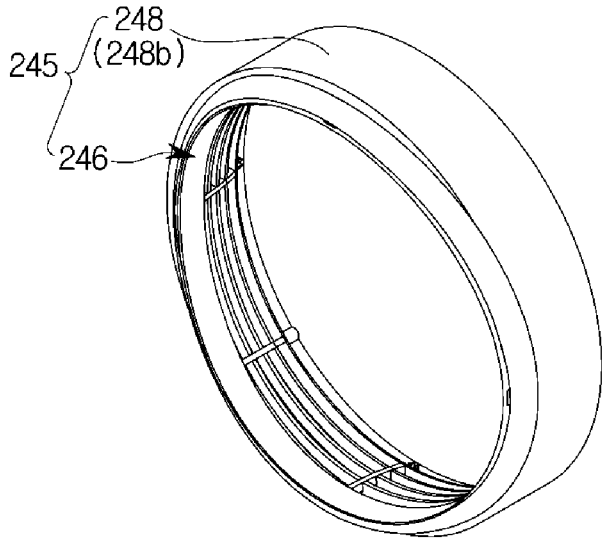
Figure 16:
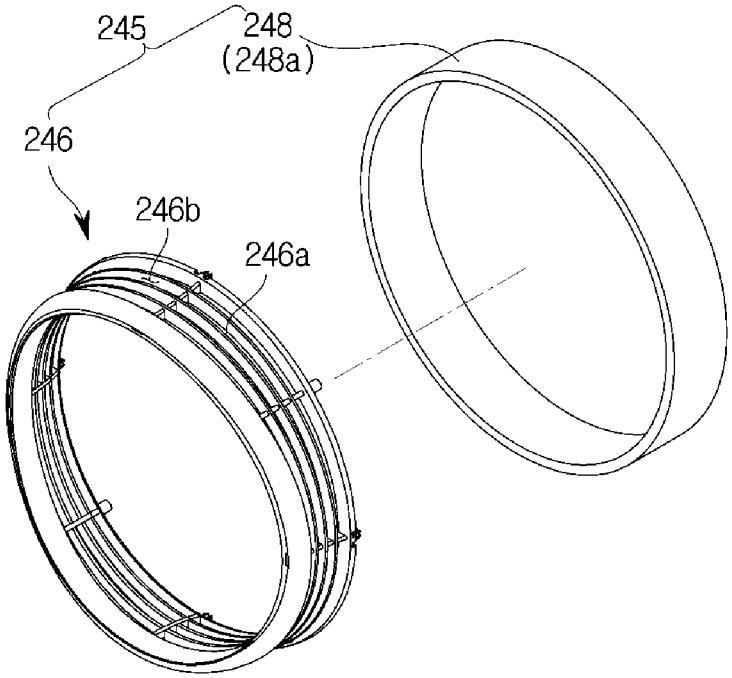

The second guide unit 247 selectively opens and closes the guide groove 246*b* of the first guide unit 246. That is, the second guide unit 247 may be moved with respect to the first guide unit 246 between an open position 247*a* and a closed position 247*b*. Particularly, when the second guide unit 247 is at the open position 247*a*, the second guide unit 247 is disposed to be spaced apart from the first guide unit 246 to open the guide groove 246*b* of the first guide unit 246. When the second guide unit 247 is in the closed position 247*b*, the second guide unit 247 is in close contact with the first guide unit 246 to close the guide groove 246*b* of the first guide unit 246. The second guide unit 247 may have a shape corresponding to that of the first guide unit 246 as illustrated in FIGS. 13 and 14 such that the second guide unit 247 is slidably moved between the open position 247*a* and the closed position 247*b* to come into close contact with the inner circumferential surface of the first guide unit 246. However, the present embodiment is not limited thereto, and a second guide unit 248 may be slidably moved between an open position 248*a* and a closed position 248*b* to come into close contact with the outer circumferential surface of the first guide unit 246 as illustrated in FIGS. 15 and 16.

Hereinafter, the discharge guide unit will be described with regard to the operation mode of the air conditioner.

When the air conditioner 1 is in the first mode, the door unit 60 is located at the door open position 60*a*. In this case, the second guide unit 247 is located at the closed position 247*b*.

When the second guide units 247 and 248 are at the closed positions 247*b* and 248*b*, the guide groove 246*b* of the first guide unit 246 is closed. Thus, heat-exchanged air inside the air conditioner 1 may be discharged only through the first discharge unit 41 via the first discharge flow path 41*a* formed inside the discharge guide unit 45. In this case, because the second discharge flow path 50*a* is closed by the second guide units 247 and 248, heat-exchanged air is not discharged through the second discharge unit 50.

When the air conditioner 1 is in the second mode, the door unit 60 is located at the door closed position 60*b*. In this case, the second guide units 247 and 248 are located at the open positions 247*a* and 248*a*.

When the second guide units 247 and 248 are located at the open positions 247*a* and 248*a*, the guide groove 246*b* of the first guide unit 246 is opened. Thus, heat-exchanged air inside the air conditioner 1 may be discharged only through the second discharge unit 50 via the second discharge flow path 50*a* formed to pass the guide groove 246*b* of the discharge guide unit 245. In this case, because the first discharge flow path 41*a* is closed by the door unit 60, heat-exchanged air is not discharged through the first discharge unit 41.

Hereinafter, an air conditioner according to an embodiment of the present disclosure will be described.

In this regard, descriptions presented above will not be repeated herein.

Figure 17:
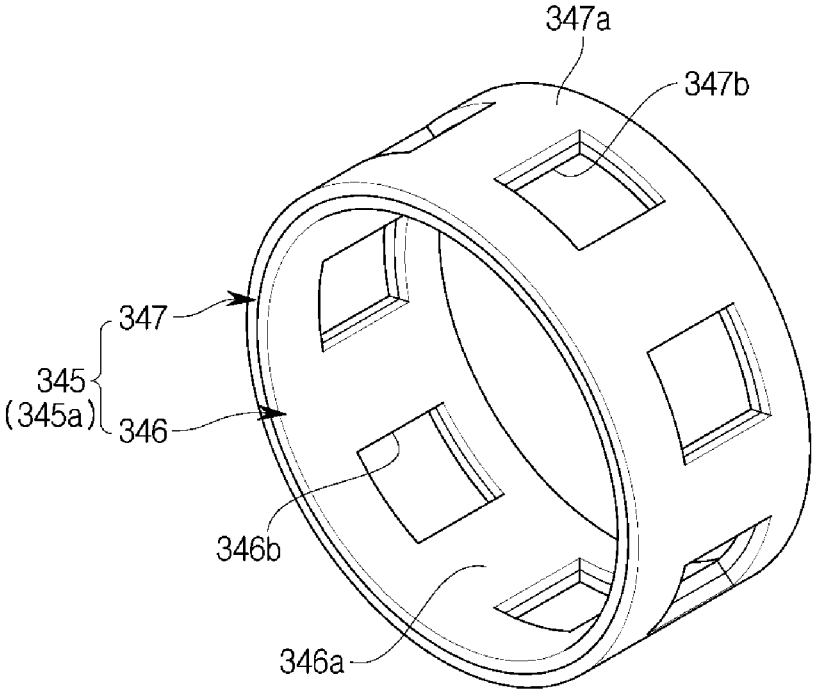
FIGS. 17 and 18 are views illustrating a discharge guide unit according to an embodiment.
Figure 18:
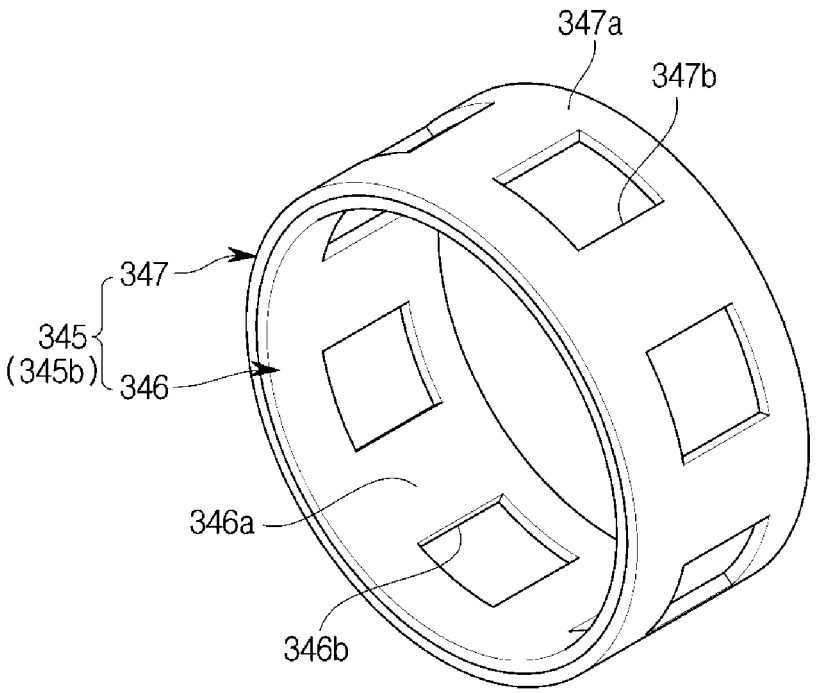

FIGS. 17 and 18 are views illustrating a discharge guide unit according to an embodiment.

A discharge guide unit 345 includes a first guide unit 346 and a second guide unit 347.

The first guide unit 346 may include a guide body 346*a* and a guide groove 346*b*.

The first guide body 346*a* may have a cylindrical shape with a hollow area. More particularly, the first guide body 346 may have a tubular shape having one side facing the air blower unit 30 and the other side facing the first discharge unit 41.

The first guide groove 346*b* may be formed at the first guide body 346*a*. The shape of the first guide groove 346*b* is not limited. The first guide groove 346*b* may have any shape disposed at the first guide body 346*a* and enabling air to flow therein. The first guide groove 346*b* may be formed to have a plurality of holes arranged along the circumference of the first guide body 346*b* according to the present embodiment.

The second guide unit 347 selectively opens and closes the first guide groove 346*b* of the first guide unit 346. That is, the second guide unit 347 may be slidably moved along the circumferential direction of the first guide unit 346. The second guide unit 347 may have a cylindrical shape with a hollow area. The second guide unit 347 may be provided in close contact with an outer circumferential surface of the first guide unit 346. However, the present embodiment is not limited thereto, and the second guide unit 347 may be in close contact with an inner circumferential surface of the first guide unit 346.

The second guide unit 347 may include a second guide body 347*a* and a second guide groove 347*b*. The second guide body 347*a* corresponds to the first guide body 346*a*, and the second guide groove 347*b* corresponds to the first guide groove 346*b*.

The discharge guide unit 345 is moved between an open position 345*a* and a closed position 345*b*. Particularly, when the discharge guide unit 345 is located at the open position 345*a*, the first guide groove 346*b* of the first guide unit 346 is located at the same position as that of the second guide groove 347*b* of the second guide unit 347. Thus, air may pass through the first and second guide grooves 346*b* and 347*b*.

When the discharge guide unit 345 is located at the closed position 345*b*, the first guide groove 346*b* of the first guide unit 346 may be located at the same position as that of the second guide body 347*a* of the second guide unit 347. On the contrary, the second guide groove 347*b* of the second guide unit 347 may be arranged at the same position as that of the first guide body 346*a* of the first guide unit 346. Through this alignment, the first and second guide grooves 346*b* and 347*b* are closed respectively by the second guide body 347*a* and the first guide body 346*a*. Thus, air cannot pass through the first and second guide grooves 346*b* and 347*b*.

The first guide unit 346 may be slidably moved in the circumferential direction of the second guide unit 347 such that the discharge guide unit 345 is moved between the closed position 345*b* and the open position 345*a*. Reversely, the second guide unit 347 may also be slidably moved in the circumferential direction of the first guide unit 346.

Hereinafter, the discharge guide unit will be described with regard to the operation mode of the air conditioner.

When the air conditioner 1 is in the first mode, the door unit 60 is located at the door open position 60*a*. In this case, the discharge guide unit 345 is located at the closed position 345*b*.

When the discharge guide unit 345 is at the closed position 345*b*, the first and second guide grooves 346*b* and 347*b* are closed. Thus, heat-exchanged air inside the air conditioner 1 may be discharged only through the first discharge unit 41 via the first discharge flow path 41*a* formed inside the discharge guide unit 345. In this case, because the first and second guide grooves 346*b* and 347*b* are closed, the second discharge flow path 50*a* is closed and heat-exchanged air is not discharged through the second discharge unit 50.

When the air conditioner 1 is in the second mode, the door unit 60 is located at the door closed position 60*b*. In this case, the discharge guide unit 345 is located at the open position 345*a*.

When the discharge guide unit 345 is at the open position 345*a*, the first and second guide grooves 346*b* and 347*b* are opened. Thus, heat-exchanged air inside the air conditioner 1 is discharged only through the second discharge unit 50 via the second discharge flow path 50*a* formed to pass the first and second guide grooves 346*b* and 347*b* of the discharge guide unit 345. In this case, because the first discharge flow path 41*a* is closed by the door unit 60, heat-exchanged air is not discharged through the first discharge unit 41.

Hereinafter, an air conditioner according to an embodiment of the present disclosure will be described.

In this regard, descriptions presented above will not be repeated herein.

Figure 19:
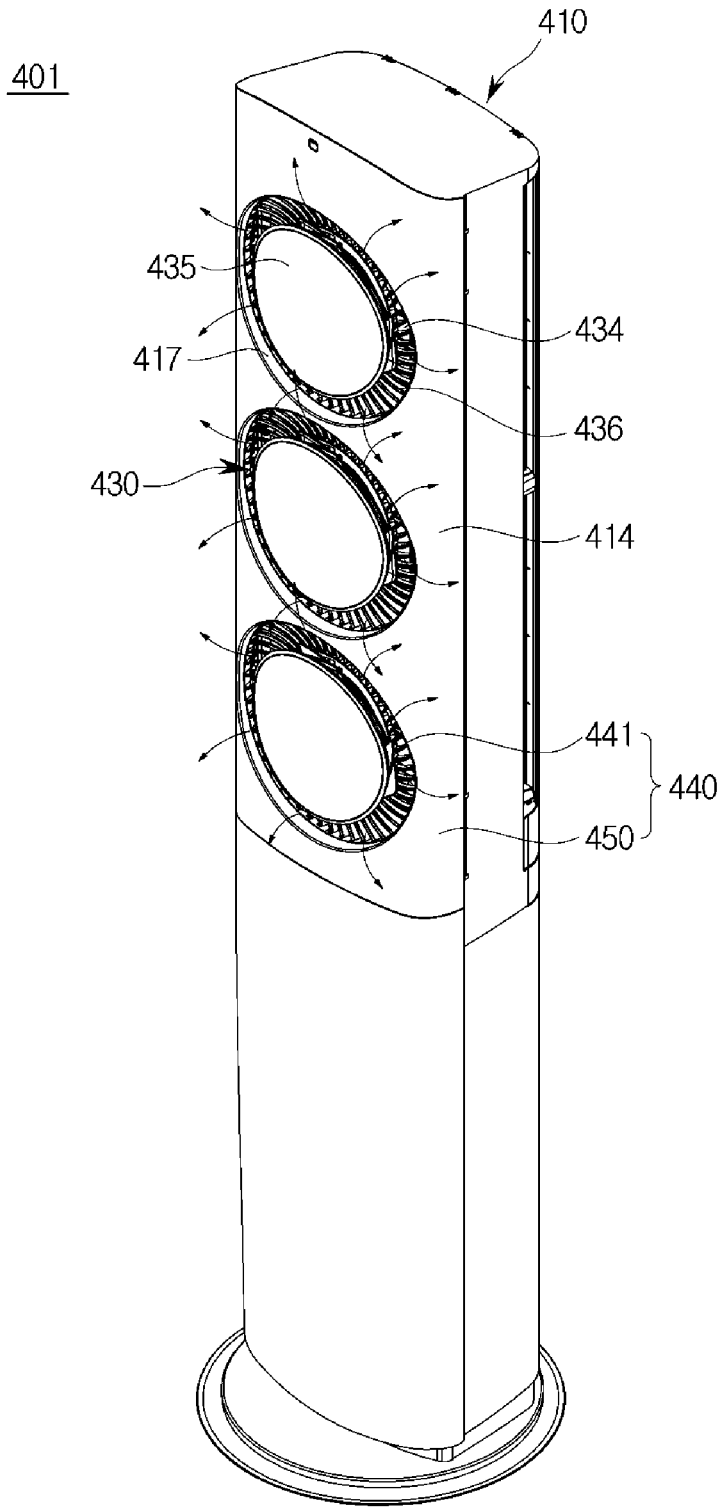
FIGS. 19 and 20 are views illustrating an air conditioner according to an embodiment.
Figure 20:
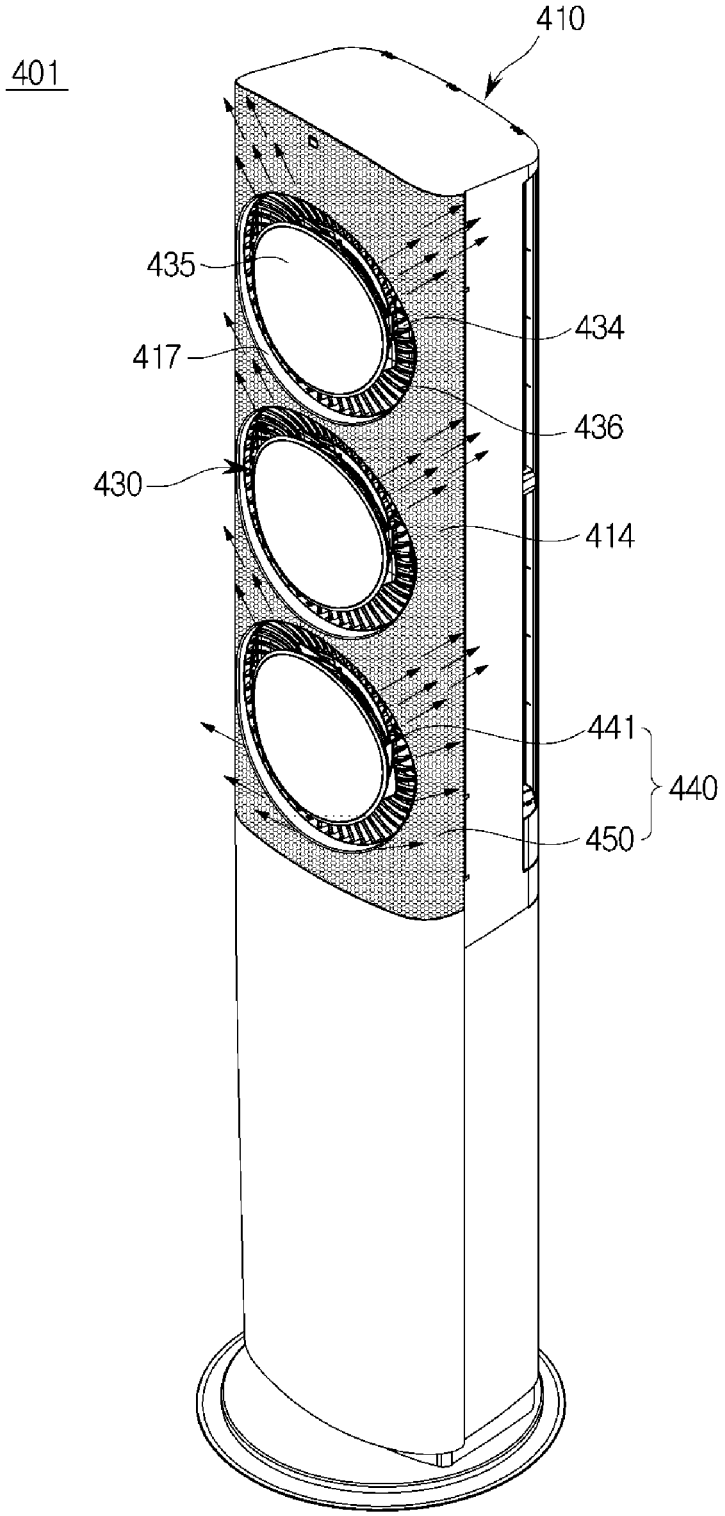

FIGS. 19 and 20 are views illustrating an air conditioner according to an embodiment.

An indoor unit of the air conditioner 401 includes a housing 410 having at least one opening 417 and defining an appearance thereof, a heat exchanger (not shown) configured to exchange heat with air flowing into the housing 410, an air blower unit 430 configured to circulate air into or out of the housing 410, and an air discharge unit 440 configured to discharge air blown from the air blower unit 430 out of the housing 410.

The air blower unit 430 may include a blower fan (not shown) and a grille 434.

The grille 434 may be arranged in an air discharge direction of the blower fan. Although a mixed flow fan is used as the blower fan according to this embodiment, types of the blower fan are not limited thereto and the blower fan may have any structure so long as external air flowing into the housing 410 is discharged out of the housing 410. For example, the blower fan may be a crossflow fan, a turbo fan, or a sirocco fan. The number of the blower fan is not limited, and at least one blower fan (not shown) may be provided to correspond to the at least one opening 417 according to the present embodiment.

The air blower unit 430 may include a fan drive unit (not shown) disposed at the center of the blower fan and used to drive the blower fan. The fan drive unit may include a motor (not shown).

The grille 434 is arranged in front of the blower fan to guide an air flow in the housing 410. In addition, the grille 434 may be disposed between the blower fan and the discharge unit to minimize external influences applied to the blower fan.

The grille 434 may include a plurality of wings 436 and a circular disc plate 435. The grille 434 may be formed such that the plurality of wings 436 extend in a radial direction around the circular disc plate 435. The plurality of wings 436 may adjust a blowing direction or volume of air blown from the blower fan toward the air discharge unit 440 by adjusting the number, shape, and alignment angle thereof.

The air discharge unit 440 may include a first discharge unit 441 and a second discharge unit 450.

The first discharge unit 441 is formed between the plurality of wings 436 of the grille 434 to discharge air inside the housing 410 to the outside, and the second discharge unit 450 is configured to discharge air inside the housing 410 through a discharge plate 414 of the housing 410.

The housing 410 may include the discharge plate 414 in which the second discharge unit 450 is formed, and the second discharge unit 450 have a plurality of discharge holes formed in the discharge plate 414. Although the discharge plate 414 is disposed at the front surface of the housing 410 according to the present embodiment, the position of the discharge plate 414 is not limited thereto. The discharge plate 414 may also be disposed at a side surface or an upper surface.

The second discharge unit 450 may be formed as a plurality of discharge holes arranged in the discharge plate 414, and air blown by the air blower unit 430 may be uniformly discharged through the second discharge unit 450 at a low wind speed.

The air conditioner 401 may have a plurality of operation modes.

The plurality of operation modes may include a first mode in which heat-exchanged air is discharged through the first discharge unit 441, a second mode in which heat-exchanged air is discharged through the second discharge unit 450, and a third mode in which conditioned air is discharged through both the first discharge unit 441 and the second discharge unit 450.

Hereinafter, an air conditioner according to an embodiment of the present disclosure will be described.

In this regard, descriptions presented above will not be repeated herein.

Figure 21:
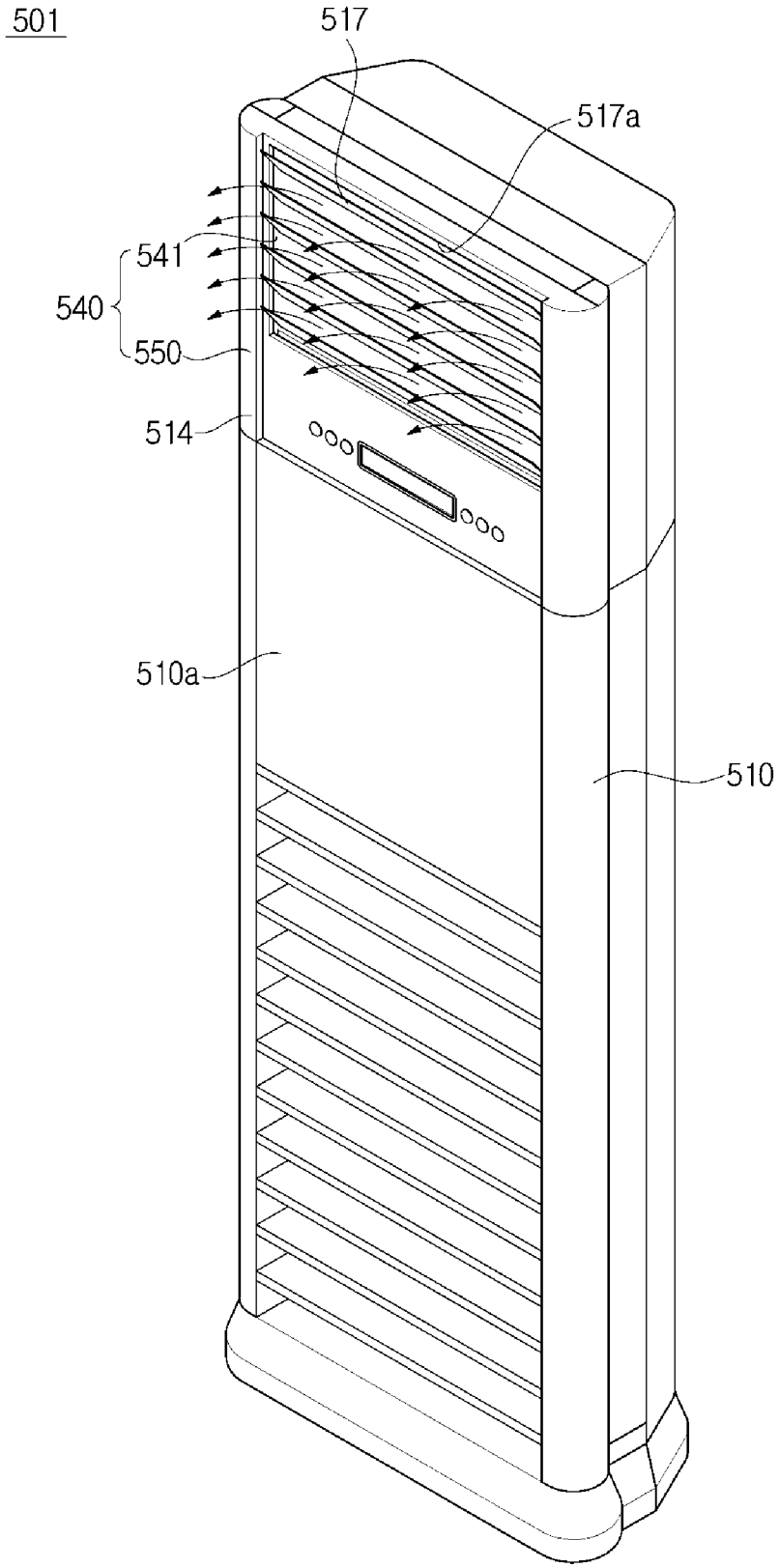
FIGS. 21 and 22 are views illustrating an air conditioner according to an embodiment.
Figure 22:
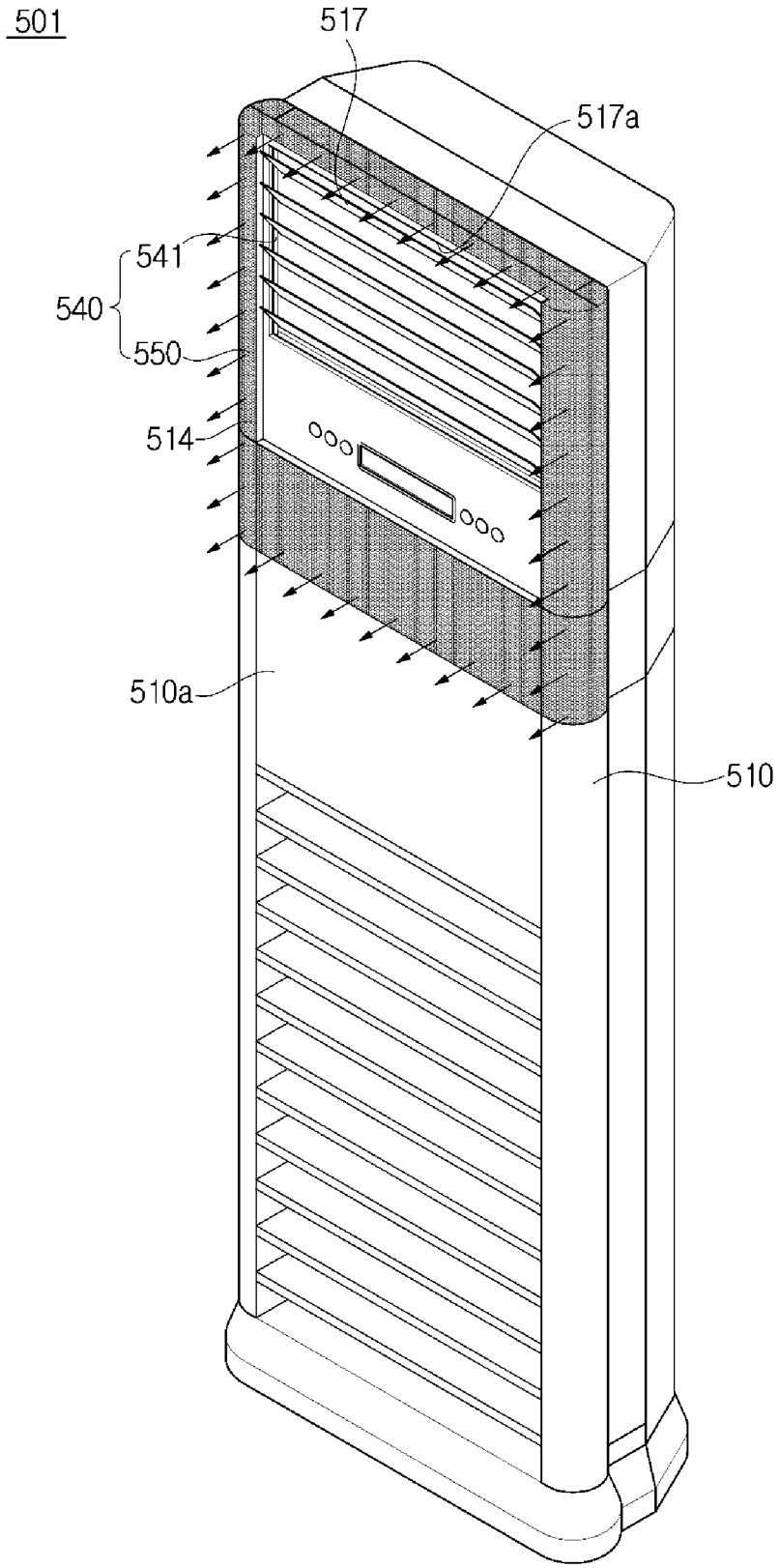

FIGS. 21 and 22 are views illustrating an air conditioner according to an embodiment.

An air conditioner 501 includes a housing 510 having at least one opening 517 and defining an appearance thereof, a heat exchanger (not shown) configured to exchange heat with air flowing into the housing 510, a blower fan (not shown) configured to circulate air into or out of the housing 410, and an air discharge unit 540 configured to discharge air blown from the blower fan (not shown) out of the housing 410.

The air discharge unit 540 may include a first discharge unit 541 and a second discharge unit 550.

The first discharge unit 541 may be formed in the opening 517. Blades 517*a* may be arranged in the opening 517 to control a blowing direction of air discharged through the first discharge unit 541. Particularly, the opening 517 may be provided at a front panel 510*a*. The blades 517*a* are disposed in the opening 517, and the blowing direction of air discharged through the first discharge unit 541 may be controlled by operating the blades 517*a*. The second discharge unit 550 is configured to discharge air inside the housing 510 through a discharge plate 514 of the housing 510.

The housing 510 may include the discharge plate 514 in which the second discharge unit 550 is formed. The second discharge unit 550 includes a plurality of discharge holes formed in the discharge plate 514. Although the discharge plate 514 is formed at the front surface of the housing 510 according to the present embodiment, the position of the discharge plate 514 is not limited thereto. For example, the discharge plate 514 may also be formed at a side surface or upper surface of the housing 510.

The second discharge unit 550 may be formed as a plurality of discharge holes arranged in the discharge plate 514, and air blown by the blower fan may be uniformly discharged through the second discharge unit 550 at a low wind speed.

The air conditioner 501 may have a plurality of operation modes.

The plurality of operation modes may include a first mode in which heat-exchanged air is discharged through the first discharge unit 541, a second mode in which heat-exchanged air is discharged through the second discharge unit 550, and a third mode in which conditioned air is discharged through both the first discharge unit 541 and the second discharge unit 550.

Hereinafter, an air conditioner according to an embodiment of the present disclosure will be described.

In this regard, descriptions presented above will not be repeated herein.

Figure 23:
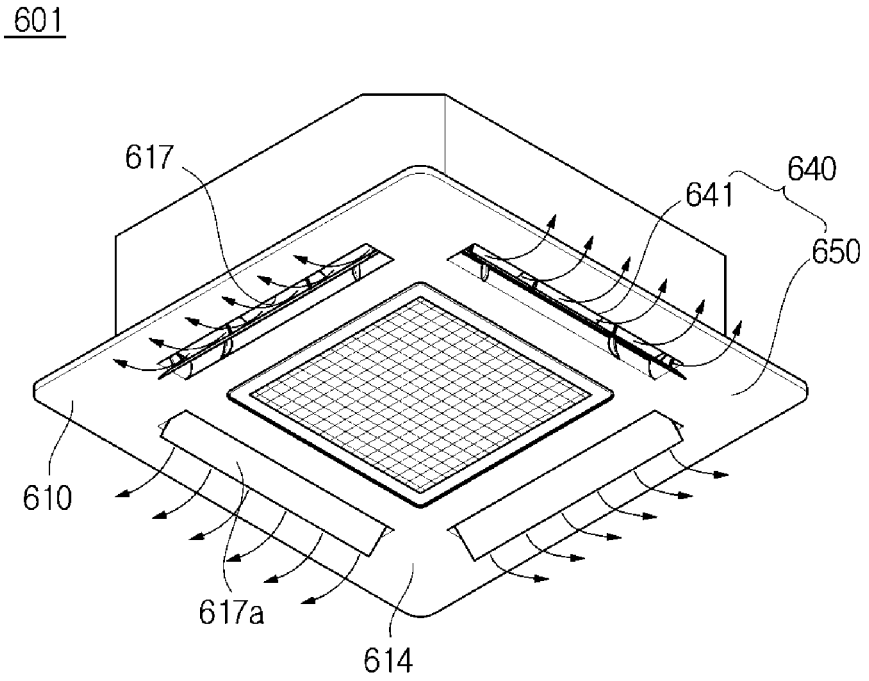
FIGS. 23 and 24 are views illustrating an air conditioner according to an embodiment.
Figure 24:
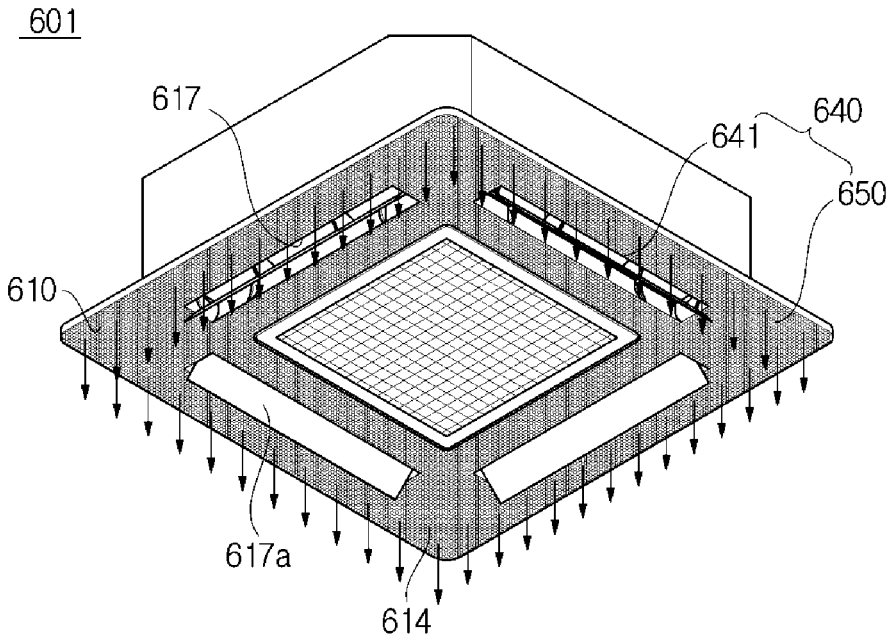

FIGS. 23 and 24 are views illustrating an air conditioner according to an embodiment.

An air conditioner 601 is installed in a ceiling.

The air conditioner 601 includes a housing 610 having at least one opening 617 and defining an appearance thereof, a heat exchanger (not shown) configured to exchange heat with air flowing into the housing 610, an air blower unit (not shown) configured to circulate air into or out of the housing 610, and an air discharge unit 640 configured to discharge air blown from the air blower unit (not shown) out of the housing 610. The housing 610 may be coupled to the ceiling. The air blower unit may include a blower fan (not shown).

The air discharge unit 640 may include a first discharge unit 641 and a second discharge unit 650.

The first discharge unit 641 may be provided in the opening 617. Blades 617*a* may be arranged in the opening 617 to control a blowing direction of air discharged through the first discharge unit 641. The second discharge unit 650 is configured to discharge air inside the housing 610 through a discharge panel 612 of the housing 610.

The housing 610 may include the discharge panel 614 in which the second discharge unit 650 is formed. The second discharge unit 650 includes a plurality of discharge holes formed in the discharge panel 614. Because the housing 610 is arranged in the ceiling and a lower surface thereof is exposed to an indoor room the discharge panel 614 may be disposed on the lower surface of the housing 610.

The second discharge unit 650 may be formed as a plurality of discharge holes arranged in the discharge panel 614, and air blown by the air blower unit may be uniformly discharged through the second discharge unit 650 at a low wind speed.

The air conditioner 601 may have a plurality of operation modes.

The plurality of operation modes may include a first mode in which heat-exchanged air is discharged through the first discharge unit 641, a second mode in which heat-exchanged air is discharged through the second discharge unit 650, and a third mode in which conditioned air is discharged through both the first discharge unit 641 and the second discharge unit 650.

Hereinafter, an air conditioner according to an embodiment of the present disclosure will be described.

In this regard, descriptions presented above will not be repeated herein.

Figure 25:
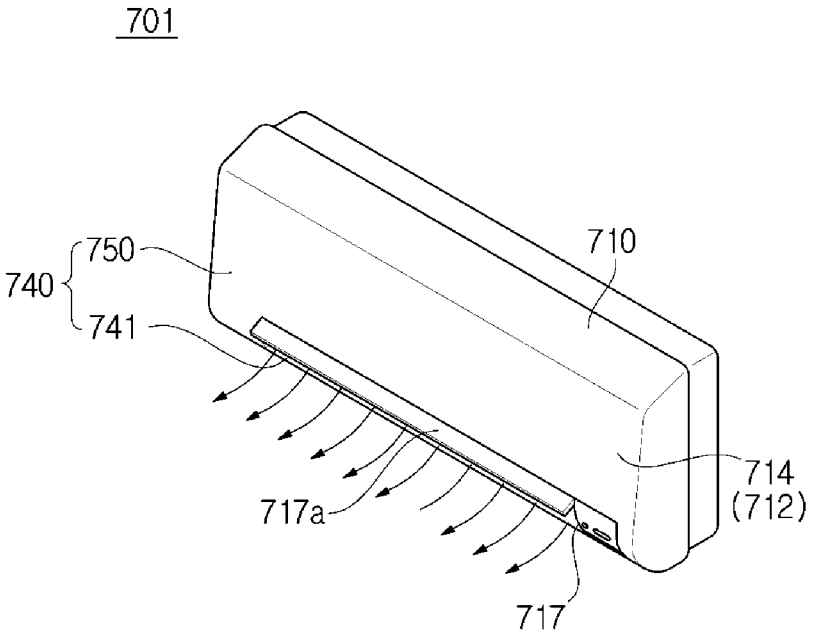
FIGS. 25 and 26 are views illustrating an air conditioner according to an embodiment.
Figure 26:
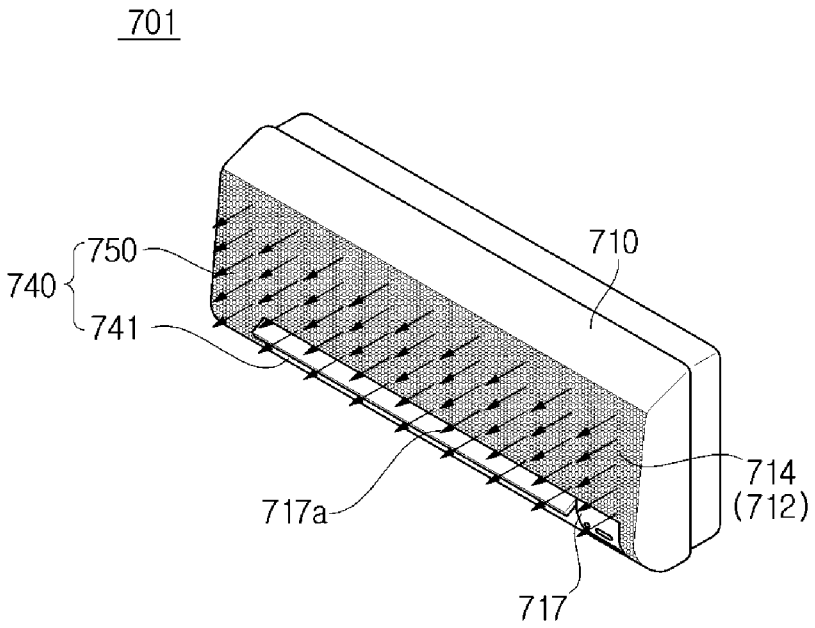

FIGS. 25 and 26 are views illustrating an air conditioner according to an embodiment.

An air conditioner 701 is fixedly mounted on a wall.

The air conditioner 701 includes a housing 710 having at least one opening 717 and defining an appearance thereof, a heat exchanger (not shown) configured to exchange heat with air flowing into the housing 710, an air blower unit (not shown) configured to circulate air into or out of the housing 710, and an air discharge unit 740 configured to discharge air blown from the air blower unit (not shown) out of the housing 710. The housing 710 may be fixed to the wall of an indoor room. The air blower unit may include a blower fan.

The air discharge unit 740 may include a first discharge unit 741 and a second discharge unit 750.

The first discharge unit 741 may be formed in the opening 717. Blades 717*a* may be arranged in the opening 717 to adjust a blowing direction of air discharged through the first discharge unit 741. The second discharge unit 750 is configured to discharge air inside the housing 710 through a discharge panel 712 of the housing 710.

The housing 710 may include a discharge plate 714 in which the second discharge unit 750 is formed. The second discharge unit 750 includes a plurality of discharge holes formed in the discharge plate 714. Although the discharge plate 714 is arranged at the front surface of the housing 710 according to the present embodiment, the position of the discharge plate 714 is not limited thereto. For example, the discharge plate 714 may be disposed at a side surface or upper surface of the housing 710.

The second discharge unit 750 may be formed as a plurality of discharge holes arranged in the discharge plate 714, and air blown by the air blower unit 730 may be uniformly discharged through the second discharge unit 750 at a low wind speed.

The air conditioner 701 may have a plurality of operation modes.

The plurality of operation modes may include a first mode in which heat-exchanged air is discharged through the first discharge unit 741, a second mode in which heat-exchanged air is discharged through the second discharge unit 750, and a third mode in which conditioned air is discharged through both the first discharge unit 741 and the second discharge unit 750.

Hereinafter, an air conditioner according to an embodiment of the present disclosure will be described.

In this regard, descriptions presented above will not be repeated herein.

Figure 27:
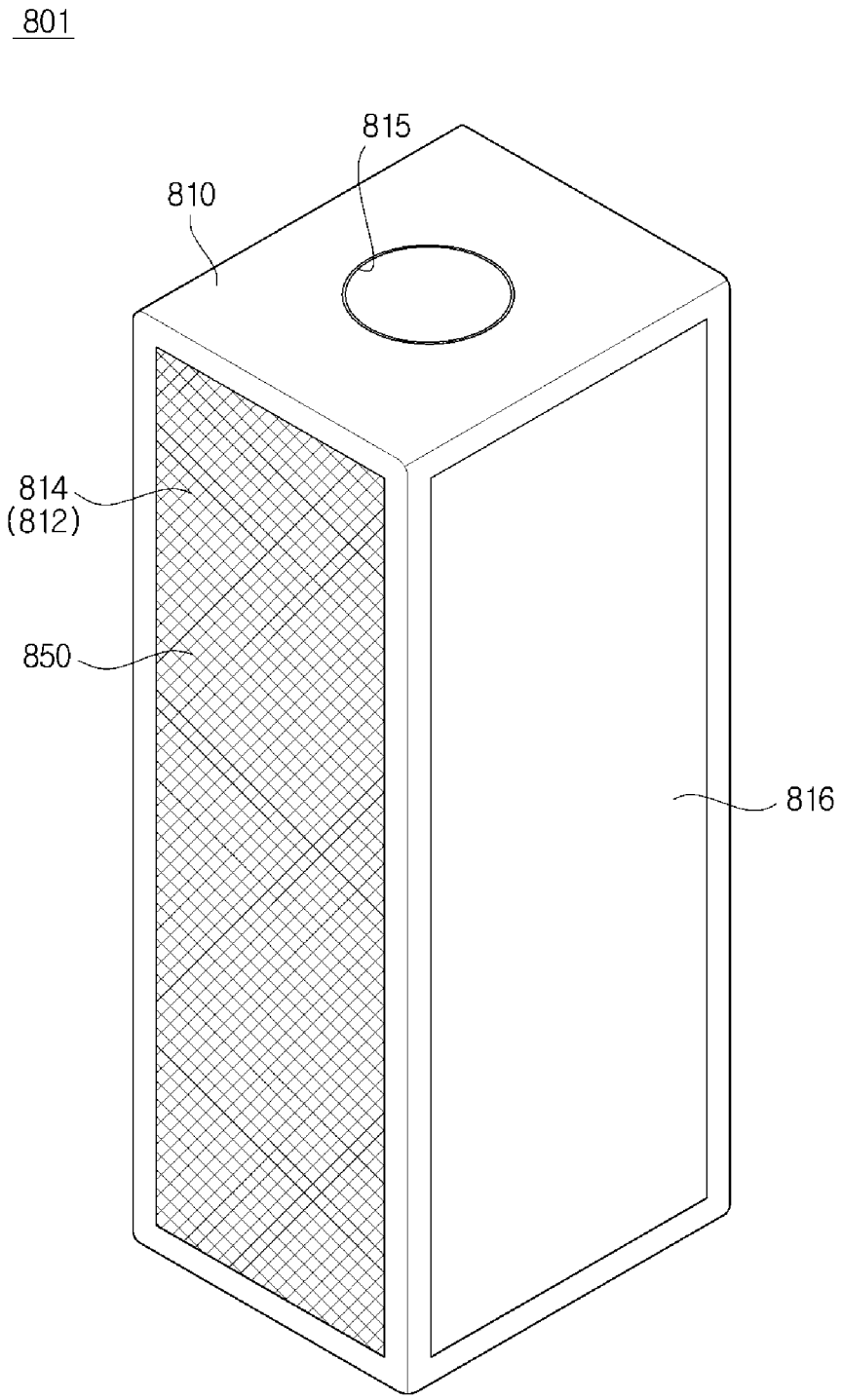
FIGS. 27 and 28 are views illustrating an air conditioner according to an embodiment.
Figure 28:
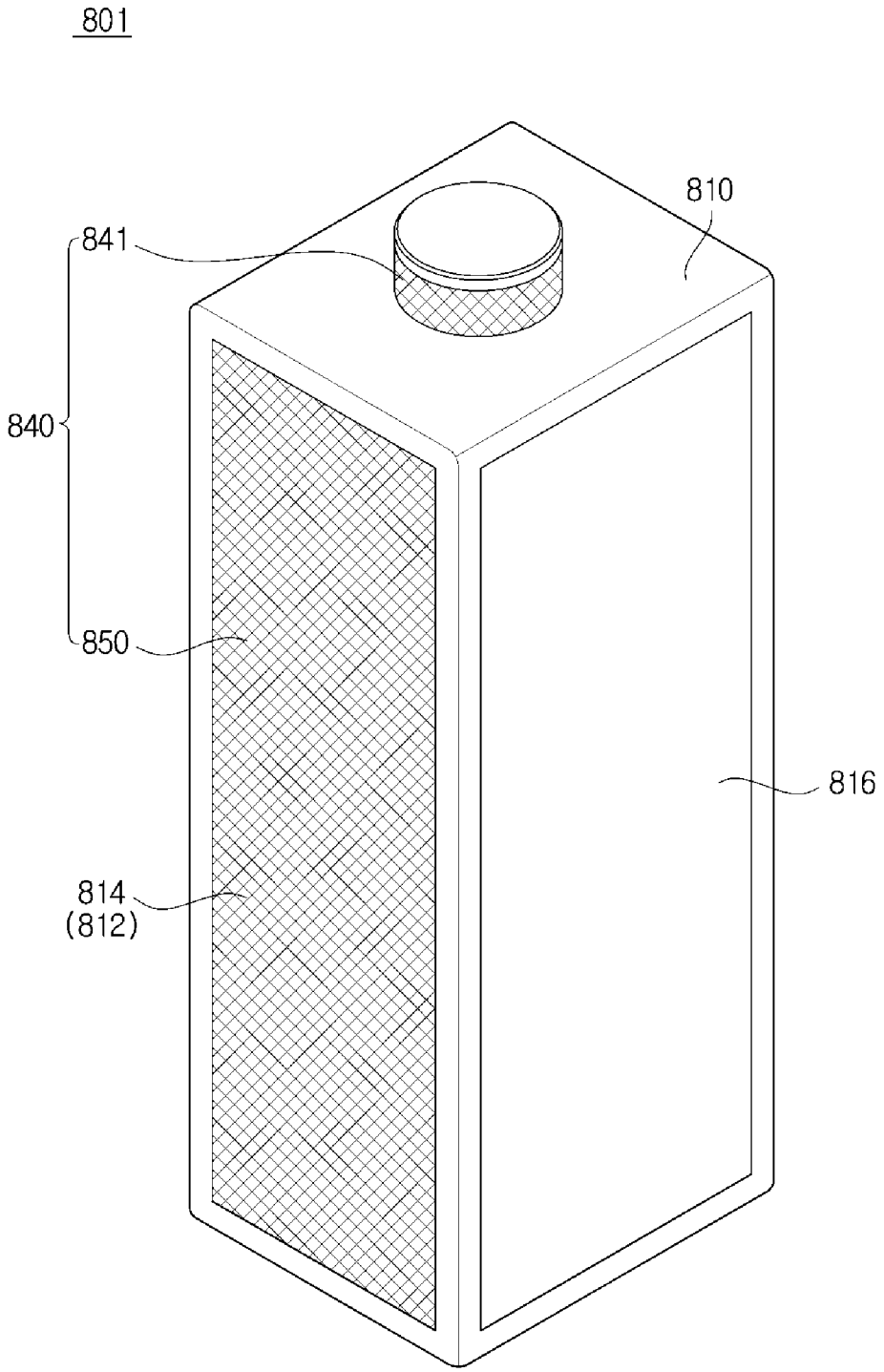

FIGS. 27 and 28 are views illustrating an air conditioner according to an embodiment.

An air cleaner 801 will be described as the air conditioner.

The air cleaner 801 includes a housing 810 defining an appearance thereof, a suction unit 816 disposed at a side of the housing 810 and sucking air from the outside of the housing 810, and an air discharge unit 840 configured to discharge air sucked by the suction unit 816 out of the housing 810.

The air cleaner 801 may include a dust collecting filter disposed in the housing 810 and filtering foreign substances contained in the air such as dust and odor particles and an air blower unit (not shown) configured to perform air blowing operation by sucking indoor air through the suction unit 816 and discharging clean air purified by the dust collecting filter through the air discharge unit 840.

The air discharge unit 840 may include a first discharge unit 841 and a second discharge unit 850.

The first discharge unit 841 is configured to discharge air purified by the dust collecting filter at a high wind speed, and the second discharge unit 850 is configured to discharge air purified by the dust collecting filter through a discharge panel 812 of the housing 810 at a low wind speed.

The first discharge unit 841 may be formed as an opening provided at the housing 810, and air blown by the air blower unit (not shown) may be directly discharged therethrough.

The housing 810 may include a discharge plate 814 at which the second discharge unit 850 is formed. The second discharge unit 850 includes a plurality of discharge holes formed in the discharge plate 814.

The second discharge unit 850 may be formed as a plurality of discharge holes arranged in the discharge plate 814, and air blown by the air blower unit 830 may be uniformly discharged through the plurality of discharge holes at a low wind speed.

The air cleaner 801 may have a plurality of operation modes.

The plurality of operation modes may include a first mode in which clean air is discharged through the first discharge unit 841, a second mode in which clean air is discharged through the second discharge unit 850, and a third mode in which clean air is discharged through both the first discharge unit 841 and the second discharge unit 850.

As is apparent from the above description, an air conditioner according to the present disclosure may discharge heat-exchanged air at different wind speeds.

In addition, a method of blowing heat-exchanged air may be changed in accordance with an environment of a user.

Furthermore, because indoor air may be conditioned without directly blowing heat-exchanged air to the user, user's satisfaction may be improved.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. An air conditioner comprising:

a housing;

a heat exchanger configured to exchange heat with air in the housing;

a fan configured to move the heat exchanged air toward an outside of the housing;

a discharge guide unit having a guide body in a cylindrical shape, a guide opening unit which forms a front of the guide body and is disposed at a front of the housing, and a guide groove disposed along a circumference of the guide body, wherein the discharge guide unit comprises:

a first guide body through which the guide groove is formed, and a second guide body which forms the guide body and is configured to open or close the guide groove by rotation of the first guide body with respect to the second guide body or rotation of the second guide body with respect to the first guide body, a door configured to open and close the guide opening unit;

wherein the air conditioner operates in a first mode and a second mode to discharge the heat exchanged air through either the guide opening unit or the guide groove:

in the first mode, the door moves away from the guide opening unit to be spaced apart from the guide opening unit to open the guide opening unit so that the discharge guide unit guides the heat exchanged air from the fan to the guide opening unit, and in the second mode, the door moves toward the guide opening unit to be in contact with the guide opening unit to close the guide opening unit so that the discharge guide unit guides the heat exchanged air from the fan to the guide groove to allow the heat exchanged air to be discharged along the circumference of the guide body through the guide groove of the discharge guide unit.

2. The air conditioner according to claim 1, wherein the air conditioner operates in a third mode where the door moves away from the guide opening unit so that the discharge guide unit guides the heat exchanged air from the fan to allow the heat exchanged air to be discharged through both the guide opening unit and the guide groove.

3. The air conditioner according to claim 1, wherein in the second mode, the discharge guide unit is configured to be in an open position in which the guide groove is open so that the heat exchanged air is guided to the guide groove, and in the first mode, the discharge guide unit is configured to be in a closed position in which the guide groove is closed so that the heat exchanged air is guided to the guide opening unit.

4. The air conditioner according to claim 3, wherein the guide groove is a first guide groove formed on the first guide body, and the second guide body includes a second guide groove that aligns with the first guide groove formed on the first guide body while the discharge guide unit is in the open position.

5. The air conditioner according to claim 3, wherein in the second mode, the first guide body is rotated so that the guide groove and the second guide body do not overlap in a radial direction of the first guide body to open the guide groove, and in the first mode, the first guide body is rotated so that the guide groove and the second guide body overlap in the radial direction of the first guide body to close the guide groove.

6. The air conditioner according to claim 1, wherein the first guide body has a cylindrical shape, and the second guide body is disposed outside an outer circumferential surface of the first guide body in a radial direction of the first guide body.

7. The air conditioner according to claim 1, wherein the housing includes an opening, and the guide opening unit is formed at a front of the first guide body and is facing the opening of the housing.

8. The air conditioner according to claim 1, wherein the second guide body is further configured to be slidably moveable along a circumference of the first guide body to open or close the guide groove formed on the first guide body.

9. The air conditioner according to claim 1, wherein the housing includes an opening disposed in front of the fan;

the first guide body forms at least part of an air passage leading from the fan to the opening of the housing.

10. The air conditioner according to claim 9, wherein the air discharged from the guide groove is discharged in a radial direction of the discharge guide unit.

11. The air conditioner according to claim 1, wherein the first guide body is rotated with respect to the second guide body and the second guide body is rotated with respect to the first guide body while moving toward each other to close the guide groove, and while moving away from each other to open the guide groove.

12. An air conditioner comprising:

a housing having an opening;

a heat exchanger disposed in the housing to exchange heat with air in the housing;

a fan configured to move the heat exchanged air toward an outside of the housing;

a door configured to open or close the opening;

a guide disposed to guide the heat exchanged air from the fan, wherein the guide comprises:

a first guide body having a plurality of holes through which the heat exchanged air is discharged; and a second guide body configured to open or close the plurality of holes of the first guide body by rotatable movement of the second guide body with respect to the first guide body or rotatable movement of the first guide body with respect to the second guide body, the first guide body and the second guide body each being in a cylindrical shape, wherein the guide allows the heat exchanged air to be discharged through the opening or through the plurality of holes.

13. The air conditioner according to claim 12, wherein the guide is configured to be in an open position in which the plurality of holes are open to guide the heat exchanged air to the plurality of holes, and the guide is configured to be in a guide position in which the plurality of holes are closed to guide the heat exchanged air to the opening.

14. The air conditioner according to claim 13, wherein the plurality of holes are formed on the first guide body, and the second guide body includes a plurality of holes that align with the plurality of the holes formed on the first guide body while the guide is in the open position.

15. The air conditioner according to claim 13, wherein the first guide body has a front side connected to the opening.

16. The air conditioner of claim 15, wherein the heat exchanged air is guided to the opening while the guide is in the guide position and the door opens the opening, and the heat exchanged air is guided through the plurality of holes while the guide is in the open position and the door closes the opening.

17. An air conditioner comprising:

a housing having an opening;

a heat exchanger configured to exchange heat with air in the housing;

a fan configured to move the air to an outside of the housing;

a discharge guide unit having a guide body in a cylindrical shape, a guide opening unit formed at a front of the guide body and facing the opening of the housing, and a guide groove that opens or closes along a circumference of the guide body, wherein the discharge guide unit comprises:

a first guide body through which the guide groove is formed, and a second guide body which forms the guide body and is configured to open or close the guide groove by rotation of the first guide body with respect to the second guide body or rotation of the second guide body with respect to the first guide body, a door configured to open and close the guide opening unit;

wherein when the door moves away from the guide opening unit, the door is spaced apart from the guide opening unit to open the guide opening unit so that the discharge guide unit guides the heat exchanged air from the fan to the guide opening unit, and when the door moves toward the guide opening unit, the door is in contact with the guide opening unit to close the guide opening unit so that the discharge guide unit guides the heat exchanged air from the fan to the guide groove to allow the heat exchanged air to be discharged along the circumference of the guide body through the guide groove of the discharge guide unit.

* * * * *